US009076581B2

(12) United States Patent
Piascik et al.

(10) Patent No.: US 9,076,581 B2
(45) Date of Patent: Jul. 7, 2015

(54) METHOD FOR MANUFACTURING HIGH TEMPERATURE ELECTROMAGNETIC COIL ASSEMBLIES INCLUDING BRAZED BRAIDED LEAD WIRES

(75) Inventors: James Piascik, Randolph, NJ (US); Robert Franconi, New Hartford, CT (US); Jacob Harding, Phoenix, AZ (US); Jimmy Wiggins, Chandler, AZ (US); Eric Passman, Piscataway, NJ (US); Richard Fox, Mesa, AZ (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 323 days.

(21) Appl. No.: 13/460,446

(22) Filed: Apr. 30, 2012

(65) Prior Publication Data

US 2013/0285776 A1 Oct. 31, 2013

(51) Int. Cl.

| | |
|---|---|
| ***H01F 7/06*** | (2006.01) |
| ***H01F 5/04*** | (2006.01) |
| ***H01F 41/10*** | (2006.01) |

(52) U.S. Cl.

CPC ..... *H01F 5/04* (2013.01); *Y10T 29/49071* (2015.01); *H01F 41/10* (2013.01)

(58) Field of Classification Search

USPC ..... 29/602.1, 605, 606, 603.24, 603.26, 29/603.236; 242/365.3, 365.6, 365.8, 366, 242/328, 329, 166; 310/179, 198, 199, 201, 310/210; 336/65, 90, 96, 107, 192, 336/206–208; 335/299

See application file for complete search history.

(56) References Cited

U.S. PATENT DOCUMENTS

| | | | |
|---|---|---|---|
| 1,722,362 | A | 7/1929 | Wiley |
| 1,742,018 | A | 12/1929 | Wermine |
| 2,262,802 | A | 11/1941 | Hayden |
| 2,787,769 | A | 4/1957 | Hill et al. |
| 2,864,929 | A | 3/1958 | Schwing |
| 2,848,794 | A | 8/1958 | Roth |
| 2,879,361 | A | 3/1959 | Haynman |
| 2,904,619 | A | 9/1959 | Forney, Jr. |
| 2,944,235 | A | 7/1960 | Peters |
| 2,997,647 | A | 8/1961 | Gaugler et al. |
| 3,019,403 | A | 1/1962 | Kamm |

(Continued)

FOREIGN PATENT DOCUMENTS

| | | |
|---|---|---|
| CN | 2529429 | 1/2003 |
| CN | 1174814 C | 11/2004 |

(Continued)

OTHER PUBLICATIONS

USPTO Office Action for U.S. Appl. No. 13/038,838, dated Apr. 22, 2013.

(Continued)

*Primary Examiner* — Paul D Kim

(74) *Attorney, Agent, or Firm* — Ingrassia Fisher & Lorenz, P.C.

(57) ABSTRACT

By way of example, a method for manufacturing an electromagnetic coil assembly includes the steps of providing a braided aluminum lead wire having a first end portion and a second end portion, brazing the first end portion of the braided aluminum lead wire to a first electrically-conductive interconnect member, and winding a magnet wire into an electromagnetic coil. The second end portion of the braided aluminum lead wire is joined to the magnet wire after the step of brazing.

20 Claims, 9 Drawing Sheets

(56) References Cited

U.S. PATENT DOCUMENTS

| | | | | | |
|---|---|---|---|---|---|
| 3,223,553 | A | | 12/1965 | Morey | |
| 3,256,417 | A | | 6/1966 | Merrett | |
| 3,308,411 | A | | 3/1967 | Roshala | |
| 3,308,414 | A | | 3/1967 | Ostrander et al. | |
| 3,336,553 | A | | 8/1967 | Cripps | |
| 3,352,009 | A | | 11/1967 | Cohn et al. | |
| 3,373,390 | A | | 3/1968 | Rechel | |
| 3,542,276 | A | | 11/1970 | James | |
| 3,688,397 | A | | 9/1972 | Cleaver et al. | |
| 3,694,785 | A | | 9/1972 | Chass | |
| 3,731,368 | A | | 5/1973 | Dieteman et al. | |
| 3,773,262 | A | * | 11/1973 | Sparling | 239/291 |
| 3,775,628 | A | | 11/1973 | Andersson et al. | |
| 3,812,580 | A | | 5/1974 | Drugmand | |
| 3,862,416 | A | | 1/1975 | Phillips et al. | |
| 3,881,163 | A | | 4/1975 | Lindroth et al. | |
| 3,932,928 | A | | 1/1976 | King | |
| 3,961,151 | A | | 6/1976 | Danner | |
| 4,056,883 | A | | 11/1977 | Danner | |
| 4,057,187 | A | | 11/1977 | Cranston et al. | |
| 4,107,635 | A | | 8/1978 | Brundage et al. | |
| 4,135,296 | A | | 1/1979 | Kami et al. | |
| 4,196,510 | A | | 4/1980 | Gudmestad et al. | |
| 4,228,415 | A | * | 10/1980 | Schantz | 335/255 |
| 4,258,347 | A | | 3/1981 | Konig | |
| 4,376,904 | A | | 3/1983 | Horrigan | |
| 4,388,371 | A | | 6/1983 | Bolon et al. | |
| 4,429,007 | A | | 1/1984 | Bich et al. | |
| 4,445,103 | A | | 4/1984 | Chass | |
| 4,476,192 | A | | 10/1984 | Imai et al. | |
| 4,524,624 | A | | 6/1985 | Di Noia et al. | |
| 4,528,086 | A | * | 7/1985 | Kato et al. | 204/427 |
| 4,554,730 | A | | 11/1985 | Westervelt et al. | |
| 4,621,251 | A | | 11/1986 | Keefe | |
| 4,636,763 | A | * | 1/1987 | Nabstedt et al. | 336/192 |
| 4,641,911 | A | | 2/1987 | Pavlak et al. | |
| 4,786,760 | A | | 11/1988 | Friedhelm | |
| 4,866,573 | A | | 9/1989 | Bernstein | |
| 4,870,308 | A | | 9/1989 | Sismour, Jr. | |
| 4,950,438 | A | | 8/1990 | Nakamura et al. | |
| 5,091,609 | A | | 2/1992 | Sawada et al. | |
| 5,105,531 | A | | 4/1992 | Sawada et al. | |
| 5,122,506 | A | | 6/1992 | Wang | |
| 5,140,292 | A | | 8/1992 | Aronow | |
| 5,211,789 | A | | 5/1993 | Christian et al. | |
| 5,226,220 | A | | 7/1993 | Gevas et al. | |
| 5,460,503 | A | | 10/1995 | Kitajima et al. | |
| 5,463,522 | A | * | 10/1995 | Van Wagener et al. | 361/103 |
| 5,475,203 | A | | 12/1995 | McGaffigan | |
| 5,493,159 | A | | 2/1996 | Norris | |
| 5,497,936 | A | | 3/1996 | Vojta et al. | |
| 5,636,434 | A | | 6/1997 | Okey et al. | |
| 5,666,099 | A | | 9/1997 | Ostrem | |
| 5,675,891 | A | | 10/1997 | Childs et al. | |
| 5,693,208 | A | | 12/1997 | Paulet | |
| 5,815,091 | A | | 9/1998 | Dames et al. | |
| 5,833,825 | A | | 11/1998 | Otten et al. | |
| 6,009,141 | A | | 12/1999 | Hell et al. | |
| 6,038,760 | A | | 3/2000 | Antoine et al. | |
| 6,189,202 | B1 | | 2/2001 | Masuda et al. | |
| 6,261,437 | B1 | | 7/2001 | Hernnaes et al. | |
| 6,368,485 | B1 | | 4/2002 | Ue et al. | |
| 6,668,067 | B2 | * | 12/2003 | Suzuki | 381/410 |
| 6,750,749 | B2 | | 6/2004 | Shirahata et al. | |
| 6,847,145 | B2 | | 1/2005 | Van Dine et al. | |
| 6,909,279 | B2 | | 6/2005 | Niwa | |
| 6,927,666 | B2 | | 8/2005 | Ahn et al. | |
| 6,976,308 | B2 | | 12/2005 | Jonli | |
| 7,129,605 | B2 | | 10/2006 | Zhang et al. | |
| 7,147,500 | B2 | | 12/2006 | Tabata et al. | |
| 7,147,929 | B2 | | 12/2006 | Amagi et al. | |
| 7,289,012 | B2 | * | 10/2007 | Tran-Ngoc et al. | 336/90 |
| 7,365,627 | B2 | | 4/2008 | Yen et al. | |
| 7,394,022 | B2 | | 7/2008 | Gumley | |
| 7,459,817 | B2 | | 12/2008 | VanLuik et al. | |
| 7,513,029 | B2 | | 4/2009 | Ortt et al. | |
| 7,572,980 | B2 | | 8/2009 | Elie et al. | |
| 7,588,530 | B2 | | 9/2009 | Heilman et al. | |
| 7,645,522 | B2 | * | 1/2010 | Bischoff et al. | 428/606 |
| 7,705,265 | B2 | | 4/2010 | Asakura et al. | |
| 7,795,538 | B2 | | 9/2010 | Kaiser et al. | |
| 7,893,583 | B2 | | 2/2011 | Du et al. | |
| 7,947,905 | B2 | | 5/2011 | Pasini | |
| 8,058,881 | B2 | * | 11/2011 | Engbring et al. | 324/529 |
| 8,128,441 | B2 | | 3/2012 | Mukuno | |
| 8,253,299 | B1 | | 8/2012 | Rittenhouse | |
| 2001/0017923 | A1 | * | 8/2001 | Suzuki | 381/150 |
| 2003/0010813 | A1 | | 1/2003 | Nakaya | |
| 2003/0020344 | A1 | | 1/2003 | Futami et al. | |
| 2003/0074884 | A1 | | 4/2003 | Snow et al. | |
| 2004/0010908 | A1 | | 1/2004 | Kobayashi | |
| 2004/0140293 | A1 | | 7/2004 | Kohama et al. | |
| 2004/0158981 | A1 | | 8/2004 | Antaya et al. | |
| 2005/0012423 | A1 | | 1/2005 | Yasuhara et al. | |
| 2005/0127774 | A1 | | 6/2005 | Sogabe et al. | |
| 2005/0225418 | A1 | * | 10/2005 | Tran-Ngoc et al. | 336/198 |
| 2007/0279047 | A1 | | 12/2007 | Schumacher | |
| 2008/0007134 | A1 | | 1/2008 | Shimura et al. | |
| 2009/0121896 | A1 | | 5/2009 | Mitchell et al. | |
| 2009/0206974 | A1 | | 8/2009 | Meinke | |
| 2009/0255319 | A1 | | 10/2009 | Sokol | |
| 2009/0273254 | A1 | | 11/2009 | Heim | |
| 2009/0325809 | A1 | | 12/2009 | Hong et al. | |
| 2010/0018768 | A1 | | 1/2010 | Takahashi et al. | |
| 2010/0031497 | A1 | | 2/2010 | Saka et al. | |
| 2010/0176683 | A1 | | 7/2010 | Waddell et al. | |
| 2010/0189884 | A1 | | 7/2010 | Kaiser et al. | |
| 2011/0054584 | A1 | | 3/2011 | Alexander et al. | |
| 2011/0080062 | A1 | * | 4/2011 | Noh et al. | 310/71 |
| 2011/0192451 | A1 | | 8/2011 | Sato et al. | |
| 2012/0126642 | A1 | | 5/2012 | Miyamoto et al. | |
| 2012/0169174 | A1 | | 7/2012 | Radov et al. | |
| 2012/0175991 | A1 | | 7/2012 | Tassinario et al. | |
| 2013/0082809 | A1 | * | 4/2013 | Holden et al. | 335/299 |
| 2013/0093550 | A1 | * | 4/2013 | Piascik et al. | 335/299 |
| 2013/0285777 | A1 | * | 10/2013 | Piascik et al. | 335/299 |
| 2014/0039258 | A1 | * | 2/2014 | Sekiguchi et al. | 600/117 |

FOREIGN PATENT DOCUMENTS

| | | | | |
|---|---|---|---|---|
| DE | 3830740 | A1 | | 3/1990 |
| DE | 102007034322 | A1 | | 1/2009 |
| DE | 102010001888 | A1 | | 8/2010 |
| EP | 0012422 | A1 | | 6/1980 |
| EP | 0886053 | A2 | | 12/1998 |
| FR | 2903246 | A1 | | 1/2008 |
| GB | 147786 | | | 4/1921 |
| GB | 569196 | | | 5/1945 |
| GB | 719126 | A | | 11/1954 |
| JP | 63209443 | A | * | 8/1988 |
| JP | 04137516 | A | * | 5/1992 |
| JP | 2005183554 | A | | 7/2005 |
| JP | 2008288512 | A | | 11/2008 |
| JP | 2012-105392 | | | 5/2012 |

OTHER PUBLICATIONS

USPTO Notice of Allowance for U.S. Appl. No. 13/038,838 dated Jul. 1, 2013.

USPTO Office Action for U.S. Appl. No. 13/460,460 dated Nov. 15, 2013.

USPTO Office Action for U.S. Appl. No. 13/187,359, dated Jan. 30, 2013.

USPTO Notice of Allowance, Notification Date Jun. 26, 2014; U.S. Appl. No. 13/276,064.

R. F. Brazier, "Cables for aircraft. Pressure-type connections." Proceedings of the Institution of Electrical Engineers, Jan. 1, 1967, p. 1307, vol. 114, No. 9.

EPO, European Extended Search Report for Application No. 12175199.4, dated Oct. 17, 2012.

USPTO Notice of Allowance, Notification Date Jun. 13, 2014; U.S. Appl. No. 13/689,266.

(56) References Cited

OTHER PUBLICATIONS

Chaklader, et al.; Alumina fibre from aluminium wire, ScienceDirect.com—Composites—Alumina fibre from aluminium wire; retrieved from internet http://www.sciencedirect.com/science/article/pii/0010436181900173.

USPTO Notice of Allowance for U.S. Appl. No. 13/187,359, dated Apr. 2, 2013.

USPTO Notice of Allowance for U.S. Appl. No. 13/460,460 dated Feb. 11, 2014.

USPTO Notice of Allowance and Fee(s) due for U.S. Appl. No. 13/689,266 dated Jan. 15, 2015.

USPTO Supplemental Notice of Allowance and Fee(s) due for U.S. Appl. No. 13/689,266 dated Feb. 23, 2015.

* cited by examiner

METHOD FOR MANUFACTURING HIGH TEMPERATURE ELECTROMAGNETIC COIL ASSEMBLIES INCLUDING BRAZED BRAIDED LEAD WIRES

TECHNICAL FIELD

The present invention relates generally to coiled-wire devices and, more particularly, to electromagnetic coil assemblies including braided lead wires brazed to other electrical connectors, as well as to methods for the production of electromagnetic coil assemblies.

BACKGROUND

Magnetic sensors (e.g., linear and variable differential transducers), motors, and actuators (e.g., solenoids) include one or more electromagnetic coils, which are commonly produced utilizing a fine gauge magnet wire; e.g., a magnet wire having a gauge from about 30 to 38 American Wire Gauge. In certain cases, the electromagnetic coils are embedded within a body of dielectric material (e.g., a potting compound) to provide position holding and electrical insulation between neighboring turns of the coils and thereby improve the overall durability and reliability of the coiled-wire device. The opposing ends of a magnet wire may project through the dielectric body to enable electrical connection between an external circuit and the electromagnetic coil embedded within the dielectric body. In many conventional, low temperature applications, the electromagnetic coil is embedded within an organic dielectric material, such as a relatively soft rubber or silicone, that has a certain amount of flexibility, elasticity, or compressibility. As a result, a limited amount of movement of the magnet wire at point at which the wire enters or exits the dielectric body is permitted, which reduces the mechanical stress applied to the magnet wire during assembly of the coiled-wire device. However, in instances wherein the electromagnetic coil is potted within a material or medium that is highly rigid, such as a hard plastic and certain inorganic materials, the magnet wire is effectively fixed or anchored in place at the wire's entry point into or exit point from the dielectric body. As the external segment of the magnet wire is subjected to unavoidable bending, pulling, and twisting forces during assembly, significant mechanical stress concentrations may occur at the wire's entry or exit point from the dielectric body. The fine gauge magnet wire may consequently mechanically fatigue and work harden at this interface during the assembly process. Work hardening of the fine gauge magnet wire may result in breakage of the wire during assembly or the creation of a high resistance "hot spot" within the wire accelerating open circuit failure of the coiled wire device. Such issues are especially problematic when the coiled magnet wire is fabricated from a metal prone to work hardening and mechanical fatigue, such as aluminum.

It would thus be desirable to provide embodiments of an electromagnetic coil assembly including a fine gauge coiled magnet wire, which is at least partly embedded within a body of dielectric material and which is effectively isolated from mechanical stress during manufacture of the coil assembly. Ideally, embodiments of such an electromagnetic coil assembly would provide redundancy in the electrical coupling to the potted coil (or coils) to improve the overall durability and reliability of the electromagnetic coil assembly. It would still further be desirable to provide embodiments of such an electromagnetic coil assembly capable of providing continuous, reliable operation in high temperature applications (e.g., applications characterized by temperatures exceeding 260° C.), such as high temperature avionic applications. Finally, it would be desirable to provide embodiments of a method for manufacturing such an electromagnetic coil assembly. Other desirable features and characteristics of the present invention will become apparent from the subsequent Detailed Description and the appended Claims, taken in conjunction with the accompanying Drawings and the foregoing Background.

BRIEF SUMMARY

Embodiments of a method for the manufacture of an electromagnetic coil assembly are provided. In one embodiment, the method for manufacturing an electromagnetic coil assembly includes the steps of providing a braided aluminum lead wire having a first end portion and a second end portion, brazing the first end portion of the braided aluminum lead wire to a first electrically-conductive interconnect member, and winding a magnet wire into an electromagnetic coil. The second end portion of the braided aluminum lead wire is joined to the magnet wire after the step of brazing.

In a further embodiment, the method for manufacturing an electromagnetic coil assembly includes the step of producing a braided aluminum lead wire having an anodized intermediate portion, a non-anodized first end portion, and a non-anodized second end portion. The non-anodized first end portion of the braided aluminum lead wire is electrically coupled to a magnet wire, and the non-anodized second end portion of the braided aluminum lead wire is joined to an electrically-conductive interconnect member.

Further provided are embodiments of an electromagnetic coil assembly. In an embodiment, the electromagnetic coil assembly includes a coiled aluminum magnet wire, an aluminum braided lead wire having a first end portion crimped to the coiled aluminum magnet wire and having a second end portion, and an electrically-conductive pin brazed to the second end portion of the aluminum braided lead wire.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
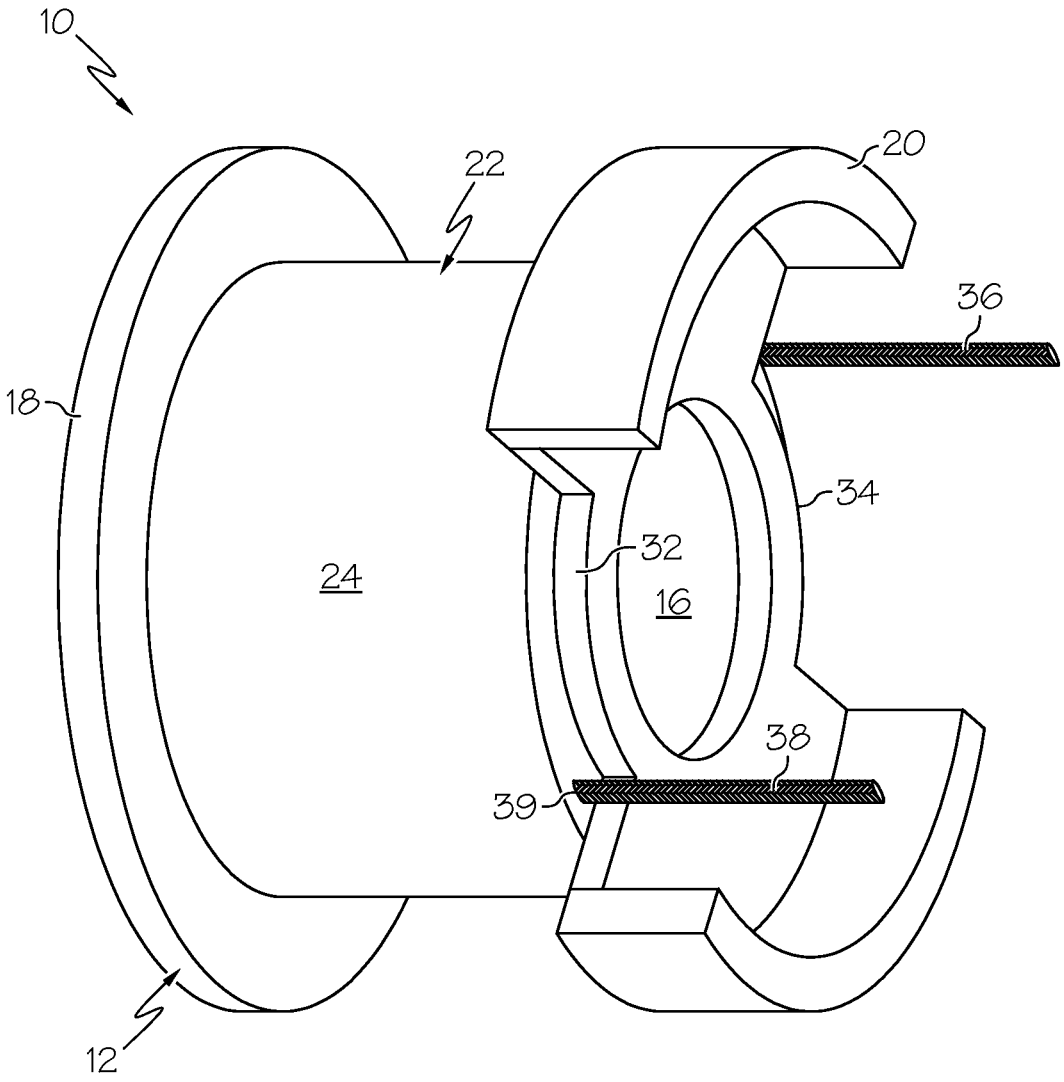
FIGS. 1 and 2 are isometric and cross-sectional views, respectively, of an electromagnetic coil assembly including a plurality of braided lead wires (partially shown) illustrated in accordance with an exemplary embodiment of the present invention.

The following Detailed Description is merely exemplary in nature and is not intended to limit the invention or the application and uses of the invention. Furthermore, there is no intention to be bound by any theory presented in the preceding Background or the following Detailed Description. As appearing herein, the term "aluminum" encompasses materials consisting essentially of pure aluminum, as well as aluminum-based alloys containing aluminum as a primary constituent in addition to any number of secondary metallic or non-metallic constituents. This terminology also applies to other metals named herein; e.g., the term "nickel" encompasses pure and near pure nickel, as well as nickel-based alloys containing nickel as a primary constituent.

The following describes embodiments of electromagnetic coil assemblies including electromagnetic coils at least partially embedded, and preferably wholly encapsulated within, an electrically-insulative medium (referred to herein as a "body of a dielectric material" or, more simply, a "dielectric body"). As described in the foregoing section entitled "BACKGROUND," the electromagnetic coils are commonly produced utilizing fine gauge magnet wires, such as magnet wires having gauges ranging from about 30 to about 38 American Wire Gauge ("AWG"). While the electromagnetic coil assembly can easily be designed such that the opposing ends of a given magnet wire project through the dielectric body to provide electrical connection to the potted coil, in instances wherein the dielectric body is relatively rigid, the magnet wire may be subject to unavoidable mechanical stresses concentrated at the wire's entry point into or exit point from the dielectric as the wire is manipulated during manufacture. In view of its relatively fine gauge, the magnet wire is generally unable to withstand significant mechanical stress without fatiguing, work hardening, and potentially snapping or otherwise breaking Work hardening and mechanical fatigue is especially problematic when the fine gauge magnet wire is fabricated from a metal, such as aluminum, prone to such issues.

To overcome the above-noted limitations, embodiments of the electromagnetic coil assemblies described herein employ braided lead wires, which terminate within the dielectric body and provide a convenient means of electrical connection to the coiled magnet wire or wires embedded therein. As will be described in more detail below, each braided lead wire assumes the form of a plurality of interwoven filaments or single-strand conductors, which are interwoven into an elongated ribbon, tube, or the like having an extremely high flexibility and mechanical strength. As a result, and in contrast to fine gauge single strand magnet wires, the braided lead wires are able to withstand significant and repeated mechanical stress without experiencing mechanical fatigue and work hardening. Furthermore, as each braided lead wire is comprised of numerous interwoven filaments, the braided lead wires provide added redundancy in the electrical connection to the potted coil or coils thereby improving the overall durability and reliability of the electromagnetic coil assembly. Additional description of electromagnetic coil assemblies employing braided lead wires is further provided in co-pending U.S. application Ser. No. 13/276,064, entitled "ELECTROMAGNETIC COIL ASSEMBLIES HAVING BRAIDED LEAD WIRES AND METHODS FOR THE MANUFACTURE THEREOF," filed Oct. 18, 2011, and bearing a common assignee with the Instant Application.

Figure 2:
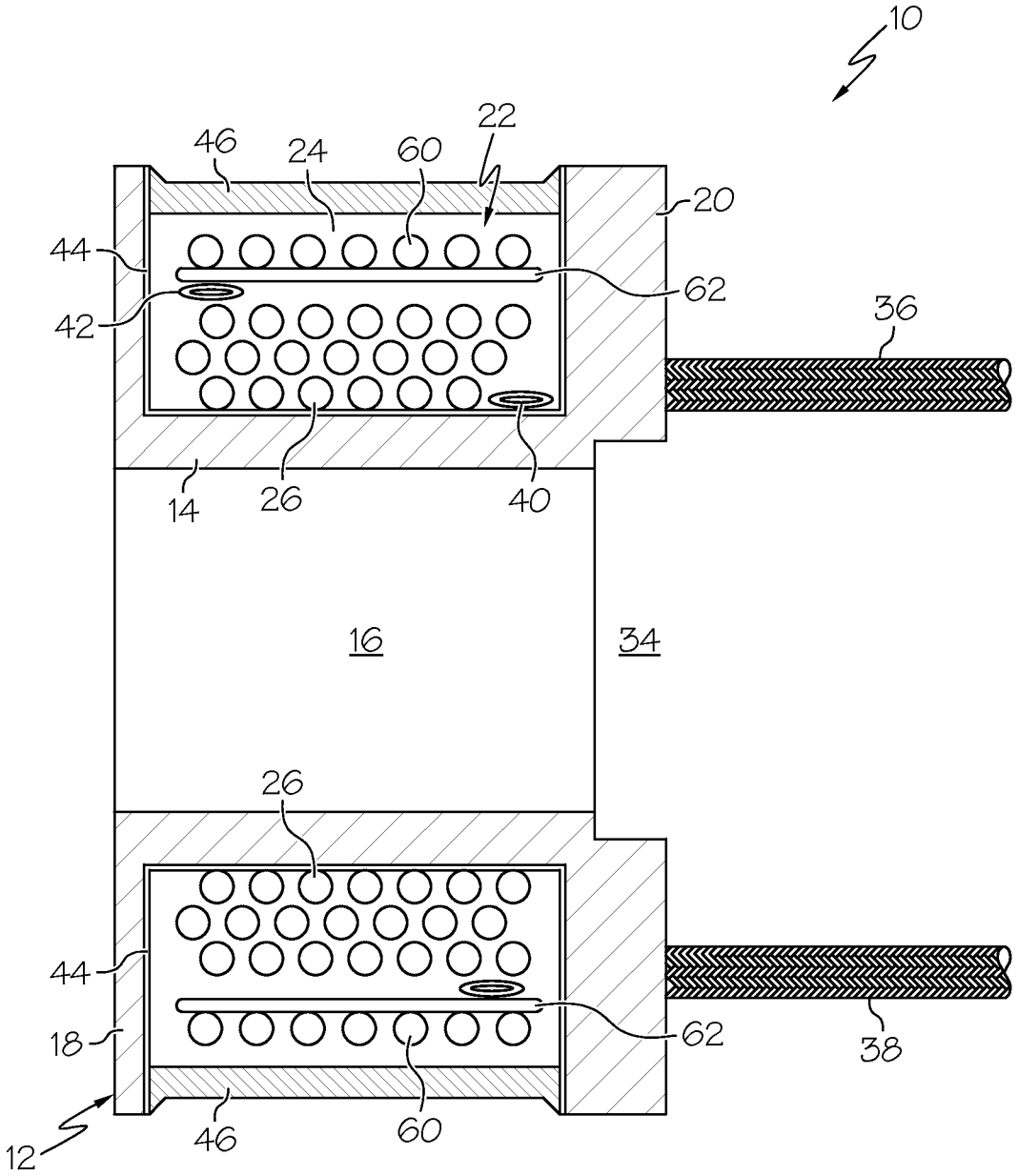

FIGS. 1 and 2 are isometric and cross-sectional views, respectively, of an electromagnetic coil assembly 10 illustrated in accordance with an exemplary embodiment of the present invention. Electromagnetic coil assembly 10 includes a support structure around which at least one magnet wire is wound to produce one or more electromagnetic coils. In the illustrated example, the support structure assumes the form of a hollow spool or bobbin 12 having an elongated tubular body 14 (identified in FIG. 2), a central channel 16 extending through tubular body 14, and first and second flanges 18 and 20 extending radially from opposing ends of body 14. As shown most clearly in FIG. 2, a magnet wire 26 is wound around tubular body 14 to form a multi-layer, multi-turn electromagnetic coil, which is embedded within a body of dielectric material 24 (referred to herein as "dielectric body 24"). In addition to providing electrical insulation between neighboring turns of coiled magnet wire 26 through the operative temperature range of the electromagnetic coil assembly 10, dielectric body 24 also serves as a bonding agent providing mechanical isolation and position holding of coiled magnet wire 26 and the lead wire segments extending into dielectric body 24 (described below). By immobilizing the embedded coil (or coils) and the embedded lead wire segments, dielectric body 24 prevents wire chaffing and abrasion when electromagnetic coil assembly is utilized within a high vibratory environment. Collectively, coiled magnet wire 26 and dielectric body 24 form a potted electromagnetic coil 22. While shown as including a single electromagnetic coil in FIGS. 1 and 2, it will be appreciated that embodiments of electromagnetic coil assembly 10 can include two or more coils positioned in various different spatial arrangements.

In embodiments wherein electromagnetic coil assembly 10 is incorporated into a sensor, such as an LVDT, bobbin 12 is preferably fabricated from a non-ferromagnetic material, such as aluminum, a non-ferromagnetic 300 series stainless steel, or a ceramic. However, in embodiments wherein assembly 10 is incorporated into a solenoid, a motor, or the like, either a ferromagnetic or non-ferromagnetic material may be utilized. Furthermore, in embodiments wherein bobbin 12 is fabricated from an electrically-conductive material, an insulative coating or shell 44 (shown in FIG. 2) may be formed over the outer surface of bobbin 12. For example, in embodiments wherein bobbin 12 is fabricated from a stainless steel, bobbin 12 may be coated with an outer dielectric material utilizing, for example, a brushing, dipping, drawing, or spraying process; e.g., a glass may be brushed onto bobbin 12 as a paste or paint, dried, and then fired to form an electrically-insulative coating over selected areas of bobbin 12. As a second example, in embodiments wherein electromagnetic coil assembly 10 is disposed within an airtight or at least a liquid-tight package, such as a hermetic canister of the type described below in conjunction with FIGS. 6 and 7, an electrically-insulative inorganic cement of the type described below may be applied over the outer surfaces of bobbin 12 and cured to produce the electrically-insulative coating providing a breakdown voltage standoff between bobbin 12 and coiled magnet wire 26. As a still further possibility, in embodiments wherein bobbin 12 is fabricated from aluminum, bobbin 12 may be anodized to form an insulative alumina shell over the bobbin's outer surface.

As previously indicated, coiled magnet wire 26 may be formed from a magnet wire having a relatively fine gauge; e.g., by way of non-limiting example, a gauge of about 30 to about 38 AWG, inclusive. However, embodiments of the present invention are also advantageously utilized when the coiled magnet wire is of a larger wire gauge (e.g., about 20 to 28 AWG) and could chip or otherwise damage the surrounding dielectric material during manipulation if allowed to pass from the interior to the exterior of dielectric body 24. Thus, in preferred embodiments, the gauge of coiled magnet wire 26 may range from about 20 to about 38 AWG. Coiled magnet wire 26 may be fabricated from any suitable metal or metals including, but not limited to, copper, aluminum, nickel, and silver. Coiled magnet wire 26 may or may not be plated. When electromagnetic coil assembly 10 is designed for usage within a high temperature environment, coiled magnet wire 26 is preferably fabricated from aluminum, silver, nickel, or clad-copper (e.g., nickel-clad copper). Advantageously, both aluminum and silver wire provide excellent conductivity enabling the dimensions and overall weight of assembly 10 to be reduced, which is especially desirable in the context of avionic applications. Relative to silver wire, aluminum wire is less costly and can be anodized to provide additional electrical insulation between neighboring turns of coiled magnet wire 26 and bobbin 12 and thereby reduce the likelihood of shorting and breakdown voltage during operation of assembly 10. By comparison, silver wire is more costly than aluminum wire, but is also more conductive, has a higher mechanical strength, has increased temperature capabilities, and is less prone to work hardening. The foregoing notwithstanding, coiled magnet wire 26 is preferably fabricated from aluminum wire and, more preferably, from anodized aluminum wire.

In low temperature applications, dielectric body 24 may be formed from an organic material, such as a hard plastic. In high temperature applications, however, dielectric body 24 is fabricated from inorganic materials and will typically be substantially devoid of organic matter. In such cases, dielectric body 24 is preferably formed from a ceramic medium or material; i.e., an inorganic and non-metallic material, whether crystalline or amorphous. Furthermore, in embodiments wherein coiled magnet wire 26 is produced utilizing anodized aluminum wire, dielectric body 24 is preferably formed from a material having a coefficient of thermal expansion ("CTE") approaching that of aluminum (approximately 23 parts per million per degree Celsius), but preferably not exceeding the CTE of aluminum, to minimize the mechanical stress applied to the anodized aluminum wire during thermal cycling. Thus, in embodiments wherein coiled magnet wire 26 is produced from anodized aluminum wire, dielectric body 24 is preferably formed to have a CTE exceeding approximately 10 parts per million per degree Celsius ("ppm per ° C.") and, more preferably, a CTE between approximately 16 and approximately 23 ppm per ° C. Suitable materials include inorganic cements, and certain low melt glasses (i.e., glasses or glass mixtures having a melting point less than the melting point of anodized aluminum wire), such as leaded borosilicate glasses. As a still more specific example, dielectric body 24 may be produced from a water-activated, silicate-based cement, such as the sealing cement bearing Product No. 33S and commercially available from the SAUEREISEN® Cements Company, Inc., headquartered in Pittsburgh, Pa.

Dielectric body 24 can be formed in a variety of different manners. In preferred embodiments, dielectric body 24 is formed utilizing a wet-winding process. During wet-winding, the magnet wire is wound around bobbin 12 while a dielectric material is applied over the wire's outer surface in a wet or flowable state to form a viscous coating thereon. The phrase "wet-state," as appearing herein, denotes a ceramic or other inorganic material carried by (e.g., dissolved within) or containing a sufficient quantity of liquid to be applied over the magnet wire in real-time during the wet winding process by brushing, spraying, or similar technique. For example, in the wet-state, the ceramic material may assume the form of a pre-cure (e.g., water-activated) cement or a plurality of ceramic (e.g., low melt glass) particles dissolved in a solvent, such as a high molecular weight alcohol, to form a slurry or paste. The selected dielectric material may be continually applied over the full width of the magnet wire to the entry point of the coil such that the puddle of liquid is formed through which the existing wire coils continually pass. The magnet wire may be slowly turned during application of the dielectric material by, for example, a rotating apparatus or wire winding machine, and a relatively thick layer of the dielectric material may be continually brushed onto the wire's surface to ensure that a sufficient quantity of the material is present to fill the space between neighboring turns and multiple layers of coiled magnet wire 26. In large scale production, application of the selected dielectric material to the magnet wire may be performed utilizing a pad, brush, or automated dispenser, which dispenses a controlled amount of the dielectric material over the wire during winding.

As noted above, dielectric body 24 can be fabricated from a mixture of at least a low melt glass and a particulate filler material. Low melt glasses having coefficients of thermal expansion exceeding approximately 10 ppm per ° C. include, but are not limited to, leaded borosilicates glasses. Commercially available leaded borosilicate glasses include 5635, 5642, and 5650 series glasses having processing temperatures ranging from approximately 350° C. to approximately 550° C. and available from KOARTAN™ Microelectronic Interconnect Materials, Inc., headquartered in Randolph, N.J. The low melt glass is conveniently applied as a paste or slurry, which may be formulated from ground particles of the low melt glass, the particulate filler material, a solvent, and a binder. In a preferred embodiment, the solvent is a high molecular weight alcohol resistant to evaporation at room temperature, such as alpha-terpineol or TEXINOL®; and the binder is ethyl cellulose, an acrylic, or similar material. It is desirable to include a particulate filler material in the embodiments wherein the electrically-insulative, inorganic material comprises a low melt glass to prevent relevant movement and physical contact between neighboring coils of the anodized aluminum wire during coiling and firing processes. Although the filler material may comprise any particulate material suitable for this purpose (e.g., zirconium or aluminum powder), binder materials having particles generally characterized by thin, sheet-like shapes (commonly referred to as "platelets" or "laminae") have been found to better maintain relative positioning between neighboring coils as such particles are less likely to dislodge from between two adjacent turns or layers of the wire's cured outer surface than are spherical particles. Examples of suitable binder materials having thin, sheet-like particles include mica and vermiculite. As indicated above, the low melt glass may be applied to the magnet wire by brushing immediately prior to the location at which the wire is coiled around the support structure.

After performance of the above-described wet-winding process, the green state dielectric material is cured to transform dielectric body 24 into a solid state. As appearing herein, the term "curing" denotes exposing the wet-state, dielectric material to process conditions (e.g., temperatures) sufficient to transform the material into a solid dielectric medium or body, whether by chemical reaction or by melting of particles. The term "curing" is thus defined to include firing of, for example, low melt glasses. In most cases, curing of the chosen dielectric material will involve thermal cycling over a relatively wide temperature range, which will typically entail exposure to elevated temperatures well exceeding room temperatures (e.g., about 20-25° C.), but less than the melting point of the magnet wire (e.g., in the case of anodized aluminum wire, approximately 660° C.). However, in embodiments wherein the chosen dielectric material is an inorganic cement curable at or near room temperature, curing may be performed, at least in part, at correspondingly low temperatures. For example, if the chosen dielectric material is an inorganic cement, partial curing may be performed at a first temperature slightly above room temperature (e.g., at approximately 82° C.) to drive out moisture before further curing is performed at higher temperatures exceeding the boiling point of water. In preferred embodiments, curing is performed at temperatures up to the expected operating temperatures of electromagnetic coil assembly 10, which may approach or exceed approximately 315° C. In embodiments wherein coiled magnet wire 26 is produced utilizing anodized aluminum wire, it is also preferred that the curing temperature exceeds the annealing temperature of aluminum (e.g., approximately 340° C. to 415° C., depending upon wire composition) to relieve any mechanical stress within the aluminum wire created during the coiling and crimping process described below. High temperature curing may also form aluminum oxide over any exposed areas of the anodized aluminum wire created by abrasion during winding to further reduces the likelihood of shorting.

In embodiments wherein dielectric body 24 is formed from a material susceptible to water intake, such as a porous inorganic cement, it is desirable to prevent the ingress of water into body 24. As will be described more fully below, electromagnetic coil assembly 10 may further include a housing or container, such as a generally cylindrical canister, in which bobbin 12, dielectric body 24, and coiled magnet wire 26 are hermetically sealed. In such cases, the ingress of moisture into the hermetically-sealed container and the subsequent wicking of moisture into dielectric body 24 is unlikely. However, if additional moisture protection is desired, a liquid sealant may be applied over an outer surface of dielectric body 24 to encapsulate body 24, as indicated in FIG. 1 at 46. Sealants suitable for this purpose include, but are limited to, waterglass, silicone-based sealants (e.g., ceramic silicone), low melting (e.g., lead borosilicate) glass materials of the type described above. A sol-gel process can be utilized to deposit ceramic materials in particulate form over the outer surface of dielectric body 24, which may be subsequently heated, allowed to cool, and solidify to form a dense water-impenetrable coating over dielectric body 24. Additional description of materials and methods useful in the formation of dielectric body 24 is provided in co-pending U.S. application Ser. No. 13/038,838, entitled "HIGH TEMPERATURE ELECTROMAGNETIC COIL ASSEMBLIES AND METHODS FOR THE PRODUCTION THEREOF," filed Mar. 2, 2011, and bearing a common assignee with the Instant Application.

To provide electrical connection to the electromagnetic coil embedded within dielectric inorganic body 24, braided lead wires are joined to opposing ends of coiled magnet wire 26. In the exemplary embodiment illustrated in FIGS. 1 and 2, specifically, first and second braided lead wires 36 and 38 are joined to opposing ends of coiled magnet wire 26. Braided lead wires 36 and 38 extend into or emerge from dielectric body 24 at side entry/exit points 39 (one of which is labeled in FIG. 1). Braided lead wires 36 and 38 each assume the form of a plurality of filaments (e.g., 24 fine gauge filaments) interwoven into a flat ribbon, an elongated tube (shown in FIGS. 1 and 2), or a similar woven structure. Braided lead wires 36 and 38 can be fabricated from a wide variety of metals and alloys, including copper, aluminum, nickel, stainless steel, and silver. Depending upon the particular metal or alloy from which braided lead wires 36 and 38 are formed, the lead wires may also be plated or clad with various metals or alloys to increase electrical conductivity, to enhance crimping properties, to improve oxidation resistance, and/or to facilitate soldering or brazing. Suitable plating materials include, but are not limited to, nickel, aluminum, gold, palladium, platinum, and silver. As shown most clearly in FIG. 1, first and second axial slots 32 and 34 may be formed through radial flange 20 of bobbin 12 to provide a convenient path for routing braided lead wires 36 and 38 to the exterior of potted electromagnetic coil 22.

Braided lead wire 36 is mechanically and electrically joined to a first segment or end of coiled magnet wire 26 by way of a first joint 40 (FIG. 2). Similarly, a second braided lead wire 38 is mechanically and electrically joined to a second segment or opposing end of coiled magnet wire 26 by way of a second joint 42 (FIG. 2). As will be described more fully below, joints 40 and 42 may be formed by any suitable combination of soldering, crimping, twisting, or the like. In preferred embodiments, joints 40 and 42 are embedded or buried within dielectric body 24. Joints 40 and 42, and therefore the opposing end segments of coiled magnet wire 26, are thus mechanically isolated from bending and pulling forces exerted on the external segments of braided lead wires 36 and 38. Consequently, in embodiments wherein coiled magnet wire 26 is produced utilizing a fine gauge wire and/or a metal (e.g., anodized aluminum) prone to mechanical fatigue and work hardening, the application of strain and stress to coiled magnet wire 26 is consequently minimized and the development of high resistance hot spots within wire 26 is avoided. By comparison, due to their interwoven structure, braided lead wires 36 and 38 are highly flexible and can be repeatedly subjected to significant bending, pulling, twisting, and other manipulation forces without appreciable mechanical fatigue or work hardening. Additionally, as braided lead wires 36 and 38 each contain a plurality of filaments, lead wires 36 and 38 provide redundancy and thus improve the overall reliability of electromagnetic coil assembly 10. If desired, an electrically-insulative (e.g., fiberglass or ceramic) cloth 62 can be wrapped around the outer circumference of coiled magnet wire 26 to further electrically insulate the electromagnetic coil and/to mechanically reinforce joints 40 and 42. Depending upon coil assembly design and purpose, and as generically represented in FIG. 2 by a single layer of wound wire 60, one or more additional coils may further be wound around the central coil utilizing similar fabrication processes.

Figure 3:
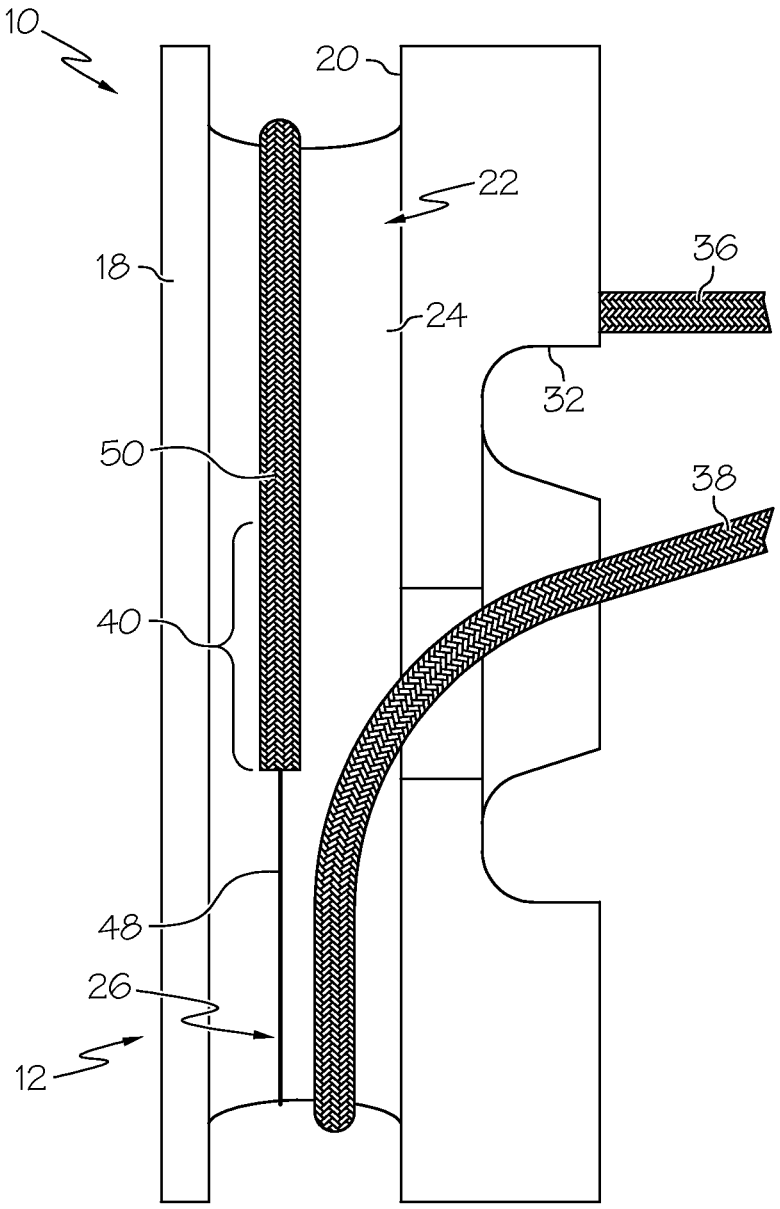
FIG. 3 is a side view of electromagnetic coil assembly shown in FIGS. 1 and 2 during an intermediate stage of manufacture and illustrating one manner in which a braided lead wire can be joined to an end segment of the coiled magnet wire.

To facilitate connection to a given braided lead wire, the coiled magnet wire is preferably inserted or threaded into the braided lead wire prior to formation of the wire-to-wire joint. In embodiments wherein the braided lead wire is a flat woven ribbon (commonly referred to as a "flat braid"), the fine gauge magnet wire may be inserted through the sidewall of the interwoven filaments and, perhaps, woven into the braided lead wire by repeatedly threading the magnet wire through the lead wire's filaments in an undulating-type pattern. Alternatively, in embodiments wherein the braided lead is an interwoven tube (commonly referred to as a "hollow braid"), an end portion of the coiled magnet wire may be inserted into the central opening of the tube or woven into the braided lead wire in the previously-described manner. For example, as shown in FIG. 3, which is a side view of electromagnetic coil assembly 10 in a partially-fabricated state, an end portion 48 of coiled magnet wire 26 may be inserted into an end portion 50 of braided lead wire 36 forming joint 40. End portion 50 of braided lead wire 38 is preferably wrapped around the circumference of the electromagnetic coil and ultimately exits the assembly through slot 32 to provide a gradual transition minimizing the application of mechanical stress to end portion 48 of coiled magnet wire 26. If desired, the portion 50 of braided lead wire 38 wrapped around the circumference of the electromagnetic coil assembly may be flattened to reduce the formation of any bulges within the finished electromagnetic coil. To provide additional electrical insulation, a flexible, electrically-insulative sleeve 56 (e.g., a woven fiberglass tube) may be inserted over the portion 50 of braided lead wire 38 wrapped around the circumference of the electromagnetic coil assembly, as further shown in FIG. 4.

As noted above, joints 40 and 42 may be formed by any suitable combination of soldering (e.g., brazing), crimping, twisting, or the like. In preferred embodiments, joints 40 and 42 are formed by soldering and/or crimping. For example, and as indicated in FIG. 5 by arrows 52, end portion 50 of hollow braided lead wire 36 may be crimped over end portion 48 of coiled magnet wire 26. In forming crimp joint 40, a deforming force is applied to opposing sides of end portion 50 of braided lead wire 38 into which end portion 48 of coiled magnet wire 26 has previously been inserted. In this manner, end portion 50 of braided hollow lead wire 38 serves as a crimp barrel, which is deformed over and around end portion 48 of coiled magnet wire 26. The crimping process is controlled to induce sufficient deformation through crimp joint 42 to ensure the creation of a metallurgical bond or cold weld between coiled magnet wire 26 and braided lead wire 38 forming a mechanical and electrical joint. Crimping can be performed with a hydraulic press, pneumatic crimpers, or certain hand tools (e.g., hand crimpers and/or a hammer). In embodiments wherein braided lead wires are crimped to opposing ends of the magnet wire, it is preferred that the braided lead wires and the coiled magnet wire are fabricated from materials having similar or identical hardnesses to ensure that the deformation induced by crimping is not overly concentrated in a particular, softer wire; e.g., in preferred embodiments wherein joints 40 and 42 are formed by crimping, coiled magnet wire 26, braided lead wire 36, and braided lead wire 38 may each be fabricated from aluminum. Although not shown in FIGS. 3-5 for clarity, braided lead wire 36 may be joined to the opposing end of coiled magnet wire 26 utilizing a similar crimping process. While only a single crimp joint is shown in FIG. 5 for simplicity, it will be appreciated that multiple crimps can be utilized to provide redundancy and ensure optimal mechanical and/or electrical bonding of the braided lead wires and the coiled magnet wire.

In addition to or in lieu of crimping, end portion 50 of braided lead wire 38 may be joined to end portion 48 of coiled magnet wire 26 by soldering. In this case, solder material, preferably along with flux, may be applied to joint 40 and heated to cause the solder material to flow into solder joint 40 to mechanically and electrically join magnet wire 26 and lead wire 38. A braze stop-off material is advantageously impregnated into or otherwise applied to braided lead wire 38 adjacent the location at which braided lead wire 38 is soldered to coiled magnet wire 26 (represented in FIG. 4 by dashed circle 54) to prevent excessive wicking of the solder material away from joint 40. Soldering may be performed by exposing the solder materials to an open flame utilizing, for example, a microtorch. Alternatively, soldering or brazing may be performed in a controlled atmosphere oven. The oven is preferably purged with an inert gas, such as argon, to reduce the formation of oxides on the wire surfaces during heating, which could otherwise degrade the electrical bond formed between coiled magnet wire 26 and braided lead wires 36 and 38. If containing potentially-corrosive constituents, such as fluorines or chlorides, the flux may be chemically removed after soldering utilizing a suitable solvent.

In certain embodiments, such as when the coiled magnet wire 26 is fabricated from an oxidized aluminum wire, it may be desirable to remove oxides from the outer surface of magnet wire 26 and/or from the outer surface of braided lead wire 38 prior to crimping and/or brazing/soldering. This can be accomplished by polishing the wire or wires utilizing, for example, an abrasive paper or a commercially-available tapered cone abrasive dielectric stripper typically used for fine AWG wire preparation. Alternatively, in the case of oxidized aluminum wire, the wire may be treated with a suitable etchant, such as sodium hydroxide (NAOH) or other caustic chemical, to remove the wire's outer alumina shell at the location of crimping and/or soldering. Advantageously, such a liquid etchant can be easily applied to localized areas of the magnet wire and/or braided lead wire utilizing a cotton swab, a cloth, or the like. When applied to the wire's outer surface, the liquid etchant penetrates the relatively porous oxide shell and etches away the outer annular surface of the underlying aluminum core thereby undercutting the outer alumina shell, which then flakes or falls away to expose the underlying core.

Figure 4:
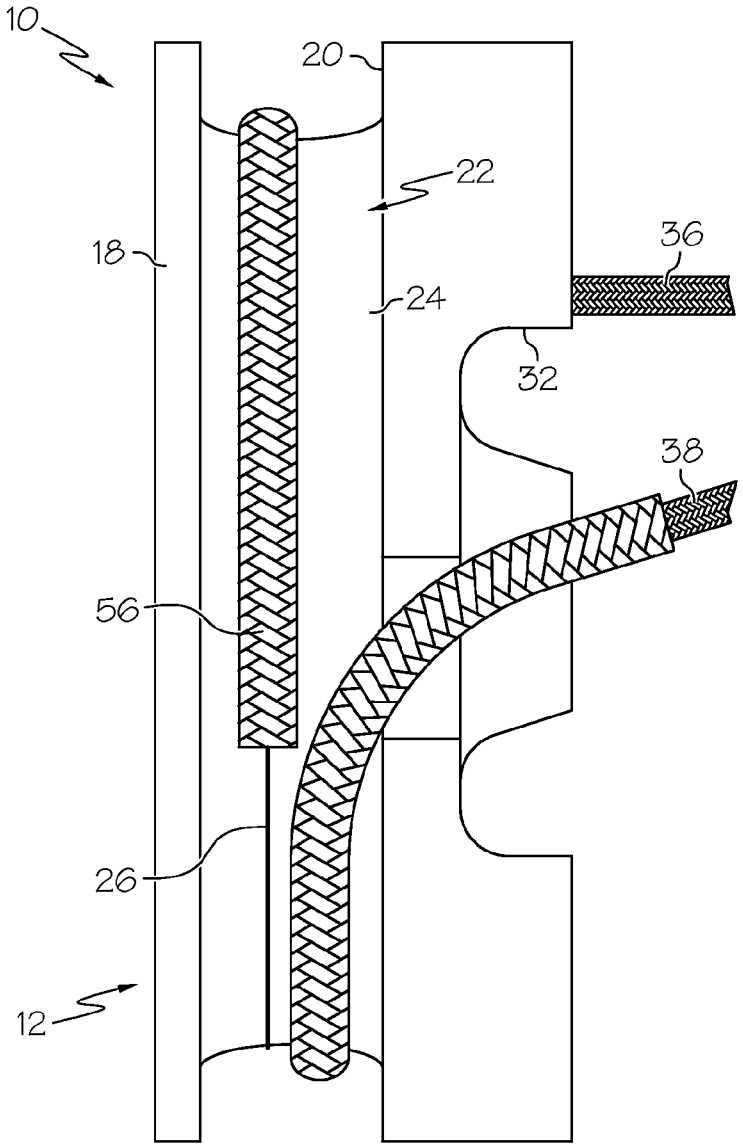
FIG. 4 is a side view of the partially-fabricated electromagnetic coil assembly shown in FIG. 3 and illustrating a flexible, electrically-insulative sleeve that may be disposed over the end segment of braided lead wire joined to the coiled magnet wire and wrapped around the electromagnetic coil.
Figure 5:
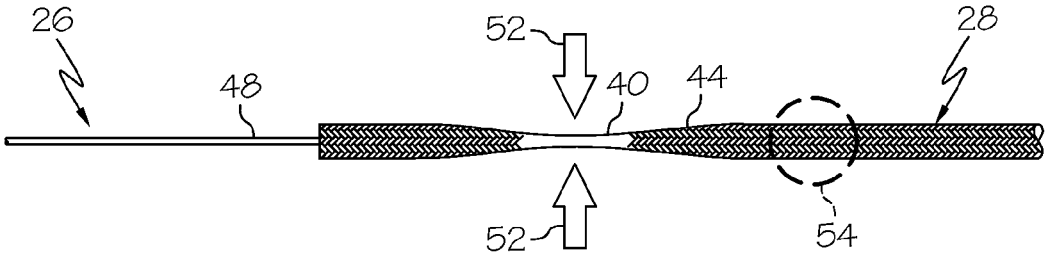
FIG. 5 is a side view of an exemplary crimp and/or solder joint that may be formed between an end segment of the coiled magnet wire and an end segment of the braided lead wire shown in FIG. 3.

In embodiment wherein braided lead wires 36 and 38 are fabricated from aluminum, additional improvements in breakdown voltage of electromagnetic coil assembly 10 (FIGS. 1-4) can be realized by anodizing aluminum braided lead wires 36 and 38 prior to joining to opposing ends of coiled magnet wire 26 (FIGS. 2-4). In one option, braided lead wires 36 and 38 are produced by interweaving a plurality of pre-anodized aluminum strands, in which case the outer alumina shell covering the terminal end portions of the braided lead wires may be removed after weaving and cutting the braids to desired lengths utilizing, for example, a caustic etch of the type described below. However, producing braided lead wires 36 and 38 by interweaving a number of pre-anodized aluminum strands is generally undesirable in view of the hardness of the alumina shells, which tends to cause excessive wear to the winding machinery utilized in the production of braided wires. Thus, in accordance with embodiments of the present invention, braided lead wires 36 and 38 are formed by first interweaving a plurality of non-anodized aluminum filaments or strands into an elongated master braid, cutting the elongated master braid into braid bundles of desired lengths, and then anodizing the braid bundles. The braid bundles can be anodized utilizing, for example, a reel-to-reel process similar to that utilized in anodization of individual wires. Alternatively, as the braided lead wires will typically be only a few inches in length, the anodization can be carried-out by racking short lengths of wire utilizing a specialized fixture and then submerging the rack in an anodization tank. Notably, the braid bundles can be anodized as a batch with several hundred braid bundles undergoing anodization during each iteration of the anodization process.

Anodization of braided lead wires 36 and 38 may entail a cleaning step, a caustic etch step, and an electrolytic process. During the electrolytic process, the braided lead wires may serve as the anode and a lead electrode may serve the cathode in a sulfuric acid solution. Aluminum metal on the outer surface of the wire is oxidized resulting in the formation of a thin (usually approximately 5 micron thick) insulating layer of alumina ($Al_2O_3$) ceramic. It is preferred to prevent the formation of an alumina shell over the end portions of the braided lead wires where electrical connections are made as bare aluminum wire will crimp and/or braze more readily. Thus, to prevent the formation of an alumina shell thereof, the end regions of the braided lead wires can be masked prior to the anodization process. Masking can be accomplished physically (e.g., by taping-over the braid lead wire end portions) or by coating with suitable resists. Alternatively, the entire wire bundle can be anodized, and the alumina shell formed over the braided lead wire ends can be chemically removed; e.g., in one embodiment, the end portions of the braided lead wires may be dipped in or otherwise exposed to caustic solution, such as a NaOH solution. In the present context, the end portions of a wire bundle or braided lead wire that are not covered, by an outer alumina shell, at least in substantial part, are considered "non-anodized," whether such end portions were not anodized during the anodization process (e.g., due to masking in the above-described manner) or such end portions were originally anodized and the outer alumina shell was subsequently removed therefrom (e.g., by treatment in a caustic solution of the type described above). Testing has shown that, by forming an insulating layer of alumina over the braided lead wires through such an anodization process, the breakdown potential of embodiments of electromagnetic coil assembly 10 (FIGS. 1-4) can be increased by a significant margin. This increase in breakdown potential adds margin and offsets the decrease in breakdown potential observed at higher temperatures.

Figure 6:
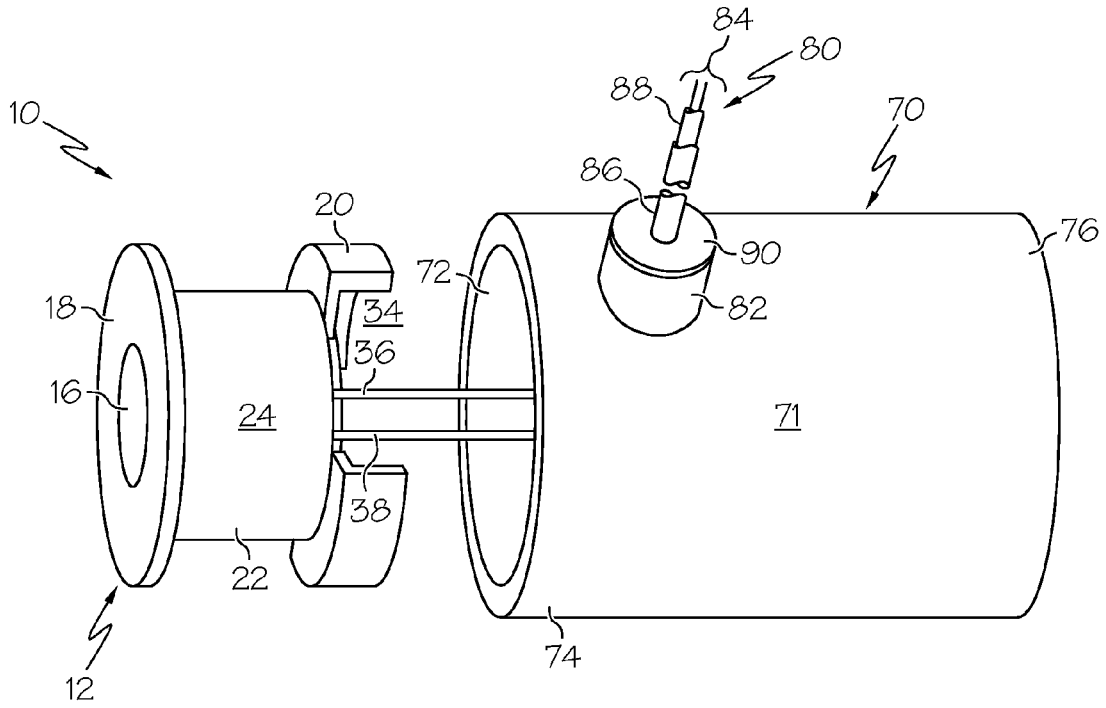
FIGS. 6 and 7 are simplified isometric views illustrating one manner in which the electromagnetic coil assembly shown in FIGS. 1 and 2 may be sealed within a canister in embodiments wherein the coil assembly is utilized within high temperature environments.

After connection of coiled magnet wire 26 to braided lead wires 36 and 38, and after formation of dielectric body 24 (FIG. 1) encapsulating coiled magnet wire 26, potted electromagnetic coil 22 and bobbin 12 may be installed within a sealed housing or canister. Further illustrating this point, FIG. 6 is an isometric view of an exemplary coil assembly housing 70 including a canister 71, which has a cavity 72 into which bobbin 12 and the potted coil 22 may be installed. In the exemplary embodiment shown in FIG. 6, canister 71 assumes the form of a generally tubular casing having an open end 74 and an opposing closed end 76. The cavity of housing 70, and specifically of canister 71, may be generally conformal with the geometry and dimensions of bobbin 12 such that, when fully inserted into housing 70, the trailing flange of bobbin 12 effectively plugs or covers open end 74 of housing 70, as described below in conjunction with FIG. 7. At least one external feedthrough connector extends through a wall of housing 70 to enable electrical connection to potted coil 22 while bridging the hermetically-sealed environment within housing 70. For example, as shown in FIG. 6, a feedthrough connector 80 (only partially shown in FIG. 6) may extend into a tubular chimney structure 82 mounted through the annular sidewall of canister 71. Braided lead wires 36 and 38 are electrically coupled to corresponding conductors included within feedthrough connector 80, whether directly or indirectly by way of one or more intervening conductors; e.g., braided lead wires 36 and 38 may be electrically connected (e.g., crimped) to the electrical conductors of an interconnect structure, which are, in turn, electrically connected (e.g., brazed) to the wires of feedthrough connector 80, as described more fully below.

Figure 7:
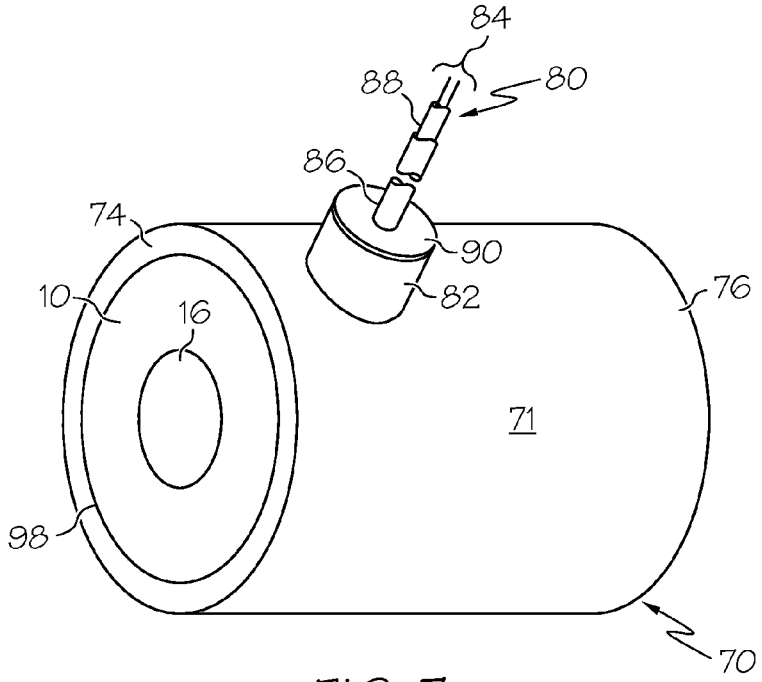

FIG. 7 is an isometric view of electromagnetic coil assembly 10 in a fully assembled state. As can be seen, bobbin 12 and potted coil 22 (identified in FIGS. 1-3 and 5) have been fully inserted into coil assembly housing 70 such that the trailing flange of bobbin 12 has effectively plugged or covered open end 74 of housing 70. In certain embodiments, the empty space within housing 70 may be filled or potted after insertion of bobbin 12 and potted coil 22 (FIGS. 1-3 and 5) with a suitable potting material. Suitable potting materials include, but are by no means limited to, high temperature silicone sealants (e.g., ceramic silicones), inorganic cements of the type described above, and dry ceramic powders (e.g., alumina or zirconia powders). In the case wherein potted coil 22 is further potted within housing 70 utilizing a powder or other such filler material, vibration may be utilized to complete filling of any voids present in the canister with the powder filler. In certain embodiments, potted coil 22 may be inserted into housing 70, the free space within housing 70 may then be filled with a potting powder or powders, and then a small amount of dilute cement may be added to loosely bind the powder within housing 70. A circumferential weld or seal 98 has been formed along the annular interface defined by the trailing flange of bobbin 12 and open end 74 of coil assembly housing 70 to hermetically seal housing 70 and thus complete assembly of electromagnetic coil assembly 10. The foregoing example notwithstanding, it is emphasized that various other methods and means can be utilized to hermetically enclose the canister or housing in which the electromagnetic coil assembly is installed; e.g., for example, a separate end plate or cap may be welded over the canister's open end after insertion of the electromagnetic coil assembly.

After assembly in the above described manner, electromagnetic coil assembly 10 may be integrated into a coiled-wire device. In the illustrated example wherein electromagnetic coil assembly 10 includes a single wire coil, assembly 10 may be included within a solenoid. In alternative embodiments wherein electromagnetic coil assembly 10 is fabricated to include primary and secondary wire coils, assembly 10 may be integrated into a linear variable differential transducer or other sensor. Due at least in part to the inorganic composition of potted dielectric body 24, electromagnetic coil assembly 10 is well-suited for usage within avionic applications and other high temperature applications.

Feedthrough connector 80 can assume the form of any assembly or device, which enables two or more wires, pins, or other electrical conductors to extend from a point external to coil assembly housing 70 to a point internal to housing 70 without compromising the sealed environment thereof. For example, feedthrough connector 80 can comprise a plurality of electrically-conductive pins, which extend through a glass body, a ceramic body, or other electrically-insulative structure mounted through housing 70. In the exemplary embodiment illustrated in FIGS. 6 and 7, feedthrough connector 80 assumes the form of a mineral-insulated cable (partially shown) including an elongated metal tube 86 containing a number of feedthrough wires 84, which extend through a wall of housing 70 and, specifically, through an end cap 90 of chimney structure 82. Although feedthrough connector 80 is depicted as including two feedthrough wires 84 in FIGS. 6 and 7, it will be appreciated that the number of conductors included within the feedthrough assembly, as well as the particular feedthrough assembly design, will vary in conjunction with the number of required electrical connections and other design parameters of electromagnetic coil assembly.

Metal tube 86, and the feedthrough wires 84 contained therein, extend through an opening provided in end cap 90 of chimney structure 82 to allow electrical connection to braided lead wires 36 and 38 and, therefore, to opposing end segments of coiled magnet wire 26 (FIG. 2). The outer surface of metal tube 86 is circumferentially welded or brazed to the surrounding portion of end cap 90 to produce a hermetic, water-tight seal along the tube-cap interface. In embodiments wherein electromagnetic coil assembly 10 is utilized within a high temperature application, elongated metal tube 86 is advantageously fabricated from a corrosion-resistant metal or alloy having high temperature capabilities, such as a nickel-based superalloy (e.g., Inconel®) or a stainless steel. Feedthrough connector 80 extends outward from housing 70 by a certain distance to provide routing of power and/or electrical signals to and/or from electromagnetic coil assembly 10 to a remote zone or area characterized by lower operative temperatures to facilitate connection to power supplies, controllers, and the like, while reducing the thermal exposure of such components to the high temperature operating environment of electromagnetic coil assembly 10.

Feedthrough wires 84 may be non-insulated or bare metal wires fabricated from one or more metals or alloys; e.g., in one implementation, feedthrough wires 84 are stainless steel-clad copper wires. In embodiments wherein feedthrough wires 84 are non-insulated, wires 84 can short if permitted to contact each other or the interior surface of elongated metal tube 86. The breakdown voltage of external feedthrough connector 80 may also be undesirably reduced if feedthrough wires 84 are allowed to enter into close proximity. While generally not a concern within metal tube 86 due to the tightly-packed composition of dielectric packing 88, undesired convergence and possible contact of feedthrough wires 84 can be problematic if wires 84 are not adequately routed when emerging from the terminal ends of feedthrough connector 80. Thus, a specialized interconnect structure may be disposed within coil assembly housing 70 to maintain or increase the lateral spacing of wires 84, and thus prevent the undesired convergence of feedthrough wires 84. When emerging from the inner terminal end of feedthrough connector 80. In addition, such an interconnect structure also provides a useful interface for electrically coupling braided lead wires 36 and 38 to their respective feedthrough wires 84 in embodiments wherein lead wires 36 and 38 and feedthrough wires 84 are fabricated from disparate materials. An example of such an interconnect structure is described below in conjunction with FIGS. 8 and 9.

Figure 8:
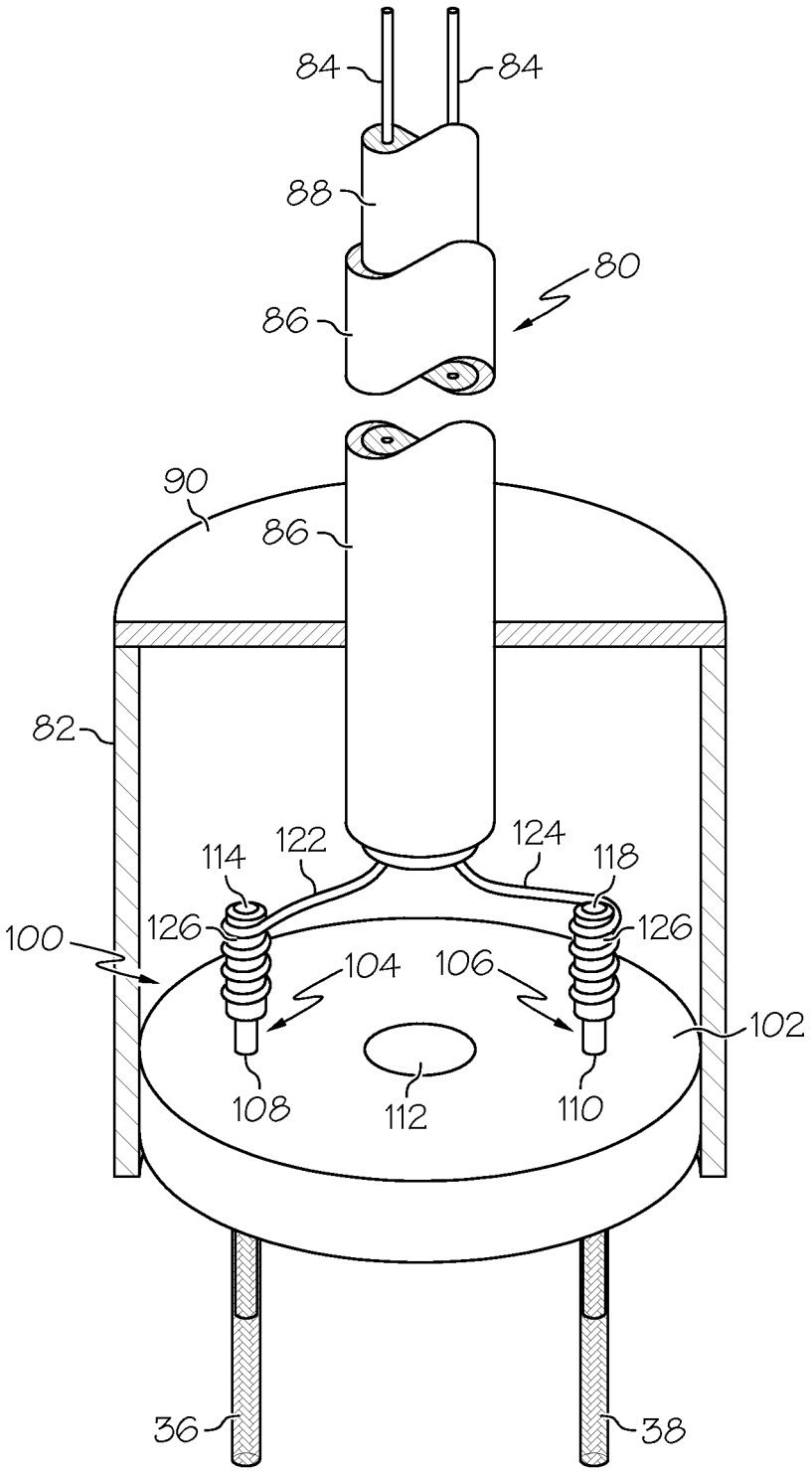
FIGS. 8 and 9 are isomeric cutaway views illustrating an interconnect structure suitable for electrically coupling the braided lead wires of the electromagnetic coil assembly shown in FIGS. 1-5 to the corresponding wires of the feedthrough connector shown in FIGS. 6 and 7, as illustrated in accordance with a further exemplary embodiment of the present invention.
Figure 9:
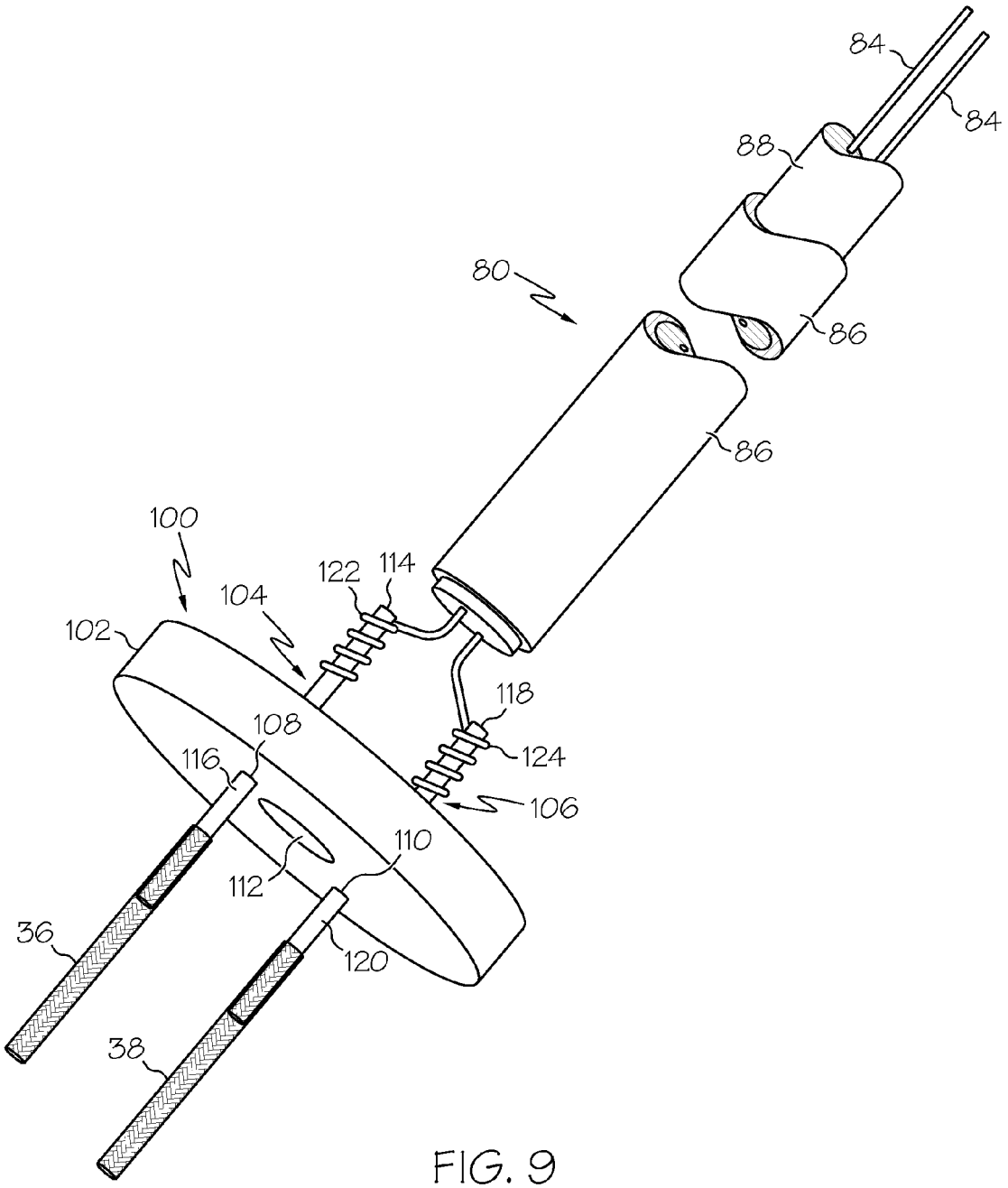

FIGS. 8 and 9 are isometric views of an interconnect structure 100, which may be disposed within coil assembly housing 70 to electrically interconnect braided lead wires 36 and 38 to the corresponding conductors (i.e., respective feedthrough wires 84) of feedthrough connector 80, as well as to maintain adequate spacing between feedthrough wires 84. Interconnect structure 100 includes an electrically-insulative body 102 through which a number of electrically-conductive interconnect members extend. In the illustrated example, specifically, first and second electrically-conductive pins 104 and 106 extend through electrically-insulative body 102. Electrically-insulative body 102 may be fabricated from any dielectric material having sufficient rigidity and durability to provide electrical isolation and spacing between electrically-conductive pins 104 and 106 and, therefore, between the exposed terminal end segments of feedthrough wires 84. In one embodiment, electrically-insulative body 102 is fabricated from a machinable ceramic, such as Macor® marketed by Corning Inc., currently headquartered in Corning, N.Y. As shown most clearly in FIG. 8, in the illustrated example wherein electrically-insulative body 102 is housed within chimney structure 82, body 102 may be machined or otherwise fabricated to have a generally cylindrical or disc-shaped geometry including an outer diameter substantially equivalent to the inner diameter of chimney structure 82. First and second through holes 108 and 110 are formed through electrically-insulative body 102 by drilling or another fabrication process to accommodate the passage of electrically-conductive pins 104 and 106, respectively. In addition, a larger aperture 112 may be drilled or otherwise formed through a central portion of electrically-insulative body 102 to permit an electrically-insulative potting compound, such as an epoxy (not shown), to be applied through body 102 during production to fill the unoccupied space within chimney structure 82 between body 102 and end cap 90 and thereby provide additional position holding of feedthrough wires 84.

Electrically-conductive pin 104 includes first and second end portions 114 and 116, which are referred to herein as "inner and outer pin terminals 114 and 116" in view of their relative proximity to potted electromagnetic coil 22 (FIGS. 1 and 6). When electrically-conductive pin 104 is inserted through electrically-insulative body 102, inner and outer pin terminals 114 and 116 extend from body 102 in opposing axial directions. Similarly, electrically-conductive pin 106 includes inner and outer pin terminals 118 and 120, which extend axially from electrically-insulative body 102 in opposing directions. Outer pin terminals 114 and 118 are electrically and mechanically joined to exposed terminal end segments 122 and 124, respectively, of feedthrough wires 84. It can be seen in FIGS. 8 and 9 that the lateral spacing between electrically-conductive pins 104 and 106 is greater than the lateral spacing between feedthrough wires 84 within elongated metal tube 86. Thus, as feedthrough wires 84 emerge from metal tube 86, the first and second feedthrough wires 84 diverge or extend away from one another to meet outer pin terminals 114 and 118, respectively. Each feedthrough wire 84 is wrapped or twisted around its respective pin terminal to maintain the exposed portions of feedthrough wires 84 in a taunt state and thereby prevent wires 84 from contacting without breakage or snapping. In preferred embodiments, electrically-conductive pins 104 and 106, or at least outer pin terminals 114 and 118, are fabricated from a non-aluminum material, such as nickel or stainless steel, having relatively high melt point as compared to aluminum. As feedthrough wires 84 are also advantageously fabricated from a non-aluminum materials, such as stainless-steel clad copper, electrically joining outer pin terminals 114 and 118 to their respective feedthrough wires 84 may be accomplished utilizing a relatively straightforward brazing process; e.g., as indicated in FIG. 8 at 126, a suitable braze material (e.g., a silver-based braze) may be applied and melted application over the portions of feedthrough wires 84 wrapped around outer pin terminals 114 and 118.

A more detailed discussion will now be provided of preferred manners by which braided lead wires 36 and 38 can be electrically and mechanically joined to inner pin terminals 116 and 120 of electrically-conductive pins 104 and 106, respectively, or other electrical connectors or conductors. As previously noted, braided lead wires 36 and 38 are advantageously fabricated from aluminum to facilitate crimping to coiled magnet wire 26 (FIG. 2), which may also be fabricated from anodized aluminum wire. By comparison, outer pin terminals 114 and 118 of electrically-conductive pins 104 and 106 (i.e., the right halves of pins 104 and 106 in FIG. 9) are conveniently fabricated from a non-aluminum material to facilitate joinder to feedthrough wires 84 by brazing or other means. It can, however, be difficult to achieve reliable mechanical and electrical bonding of a non-aluminum conductor to fine gauge aluminum wire, including braided lead wires formed from a number of interwoven fine gauge aluminum filaments or strands, utilizing traditional wire joinder techniques. For example, crimping of fine gauge aluminum wire can result in work hardening of the aluminum wire. In addition, in instances wherein the aluminum wire is crimped to a second wire fabricated from a metal having a hardness exceeding that of aluminum, the deformation induced by crimping may be largely concentrated in the aluminum wire and an optimal physical mechanical and/or electrical bond may not be achieved.

In contrast to crimping, soldering or brazing does not require the application of deformation forces to the wire-to-wire or pin-to-wire interface, which can cause the above-noted issues with fine gauge aluminum wire. While the terms "soldering" and "brazing" are commonly utilized to denote joining techniques wherein filler materials melt above or below 450° C., such terms are utilized interchangeably herein, as are the terms "solder joint" and "braze joint." However, brazing of fine gauge aluminum wire also presents certain difficulties. Due to its relatively low melt point and thermal mass, fine gauge aluminum wire can easily be overheated and destroyed during the brazing processing. The likelihood of inadvertently overheating the aluminum wire is especially pronounced when brazing is carried-out in a relatively confined space utilizing, for example, a microtorch. Heating during brazing can also result in formation of oxides along the wires' outer surfaces increasing electrical resistance across the braze joint. As a still further drawback, moisture present at the braze interface can accelerate corrosion and eventual connection failure when aluminum wire is joined to a secondary wire formed from a metal, such as copper, having an electronegative potential that differs significantly as compared to aluminum wire.

In accordance with embodiments of the present invention, braided lead wires 36 and 38 are joined to terminal end portions 116 and 120, respectively, of electrically-conductive pins 104 and 106 by brazing. To overcome the above-noted drawbacks associated with brazing of fine gauge aluminum wire, braided lead wires 36 and 38 are brazed to interconnect pins 104 and 106 prior to connection to opposing end segments of coiled magnet wire 26 (FIG. 2). Such a pre-brazing process can be performed independently or separately from the other components of electromagnetic coil assembly 10 (FIGS. 1-7) in a highly controlled environment, such as induction or vacuum furnace. In this manner, it can be ensured that the braided lead wires 36 and 38 are heated to a predetermined braze temperature sufficient to melt the braze material, while not overheating and potentially destroying lead wires 36 and 38. In addition, the pre-brazing process is preferably performed in a non-oxidizing (i.e., an inert or reducing) atmosphere to minimize the formation of oxides along the braze joint. An exemplary method 130 is described below in conjunction with FIG. 10 suitable for fabricating an electromagnetic coil assembly, such as electromagnetic coil assembly 10 shown in FIGS. 1-7, wherein braided lead wires 36 and 38 are pre-brazed to pins 104 and 106 (or other electrical conductors) in this manner.

Figure 10:
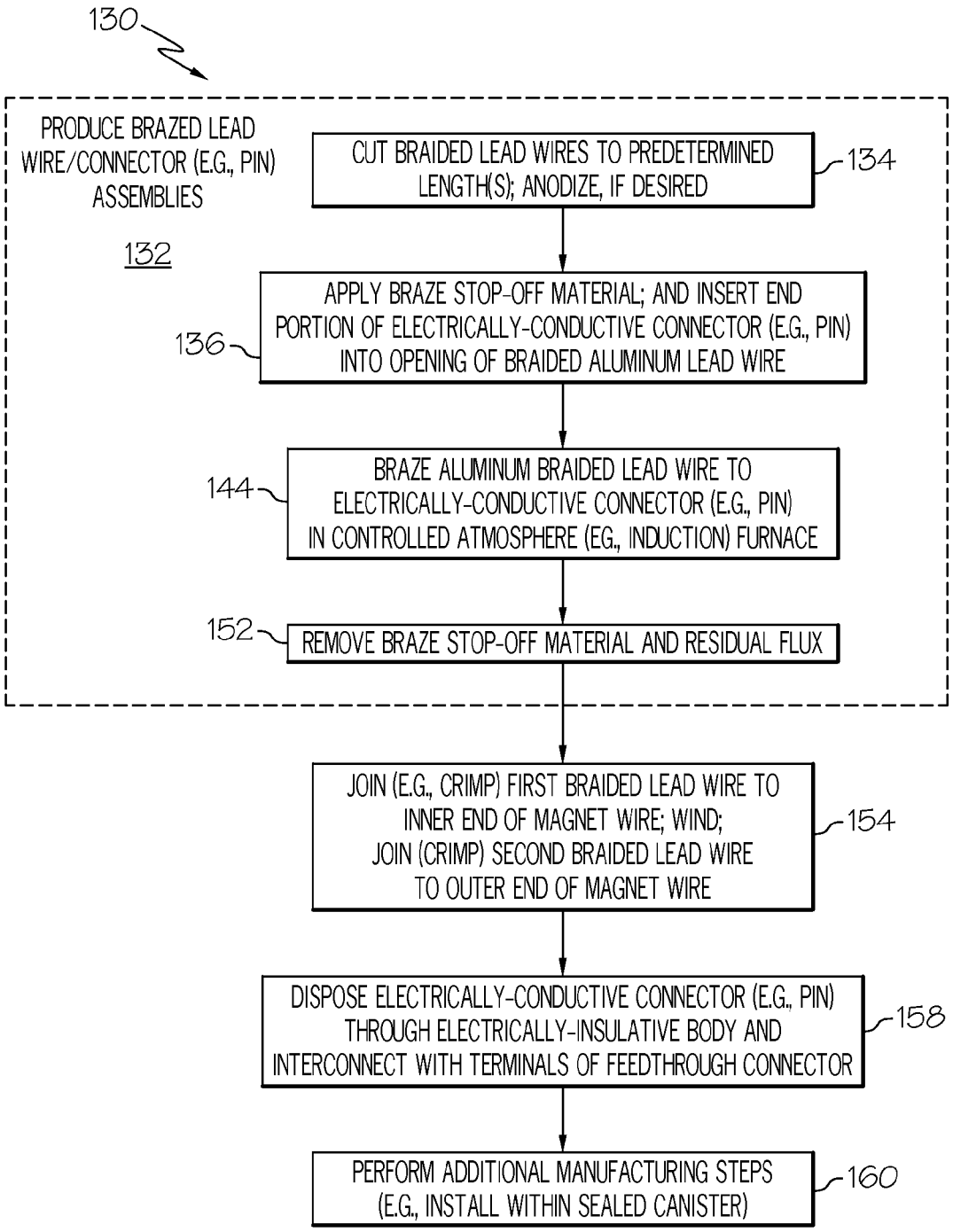
FIG. 10 is a flowchart illustrating an exemplary method for fabricating an electromagnetic coil assembly, such as the electromagnetic coil assembly shown in FIGS. 1-7, wherein at least one braided lead wire is pre-brazed to an interconnect pin, such as an electrically-conductive pin of the interconnect structure shown in FIGS. 8 and 9.

FIG. 10 is an exemplary method 130 for fabricating an electromagnetic coil assembly wherein one or more braided lead wires are pre-brazed to electrical conductors (e.g., the electrically-conductive members of an interconnect structure, such as electrically-conductive pins 104 and 106 of exemplary interconnect structure 100 shown in FIGS. 8 and 9) and subsequently joined to the end portion(s) of one or more magnet wires. For convenience of explanation, method 130 will be described below in conjunction with exemplary coil assembly 10 shown in FIGS. 1-7; however, it will be appreciated that method 130 can be utilized to fabricate electromagnetic coil assemblies having different structure features. It should further be understood that the steps illustrated in FIG. 10 and described below are provided by way of example only; and that in alternative embodiments of method 130, additional steps may be performed, certain steps may be omitted, and/or the steps may be performed in alternative sequences.

Exemplary method 130 commences with the production of number of brazed lead wire/connector assemblies and, in one specific example, a number of brazed lead wire/pin assemblies (BLOCK 134, FIG. 10). First, a number of braided lead wires are cut to one or more desired lengths (STEP 136, FIG. 10). The number of braided lead wires produced will inevitably vary amongst different implementations of method 130; however, it is noted that brazed lead wire/pin assemblies can be efficiently produced in batches ranging in number from several dozen to several hundred. In each batch, one group of braided lead wires may be cut to a first length for attachment to a first end segment of coiled magnet wire 26 (FIGS. 1 and 6), while a second group of braided lead wires may be cut to a second length for attached to a second end segment of coiled magnet wire 26. Although by no means necessary, the braided lead wires can be anodized during STEP 136 to increase the breakdown voltage of the electromagnetic coil assembly in which the braided lead wires are employed. In this regard, the braided lead wires may be formed by first interweaving a plurality of non-anodized aluminum filaments or strands into an elongated master braid, cutting the elongated master braid into braid bundles of desired lengths, and then anodizing the braid bundles. The braid bundles can be anodized utilizing, for example, a reel-to-reel process similar to that utilized in anodization of individual wires. Alternatively, as the braided lead wires will often be only a few inches in length each, anodization can be carried-out by racking short lengths of wire utilizing a specialized fixture and submerging the rack in an anodization bath. Prior to the electrolytic anodization process, the wire braids may be cleaned and/or subjected to a caustic etch solution, such as a sodium hydroxide (NaOH) solution. During the electrolytic process, the wire bundles or braided lead wires are submerged in the anodizing bath, which may contain a sulfuric acid solution. The braided lead wires may serve as the anode, while a lead electrode may serve as the cathode. As the surface of the wires oxidize, the outer regions of aluminum metal are converted to an electrically-insulative layer of alumina ($Al_2O_3$) ceramic. The anodization process may be controlled to grow a relatively thin outer alumina shell having a thickness of, for example, about 5 microns.

While it is desirable to form an electrically-insulative oxide shell over the elongated bodies of the braided lead wires, it is generally desirable to prevent the formation of an alumina shell over the terminal end portions of the braided lead wires to facilitate electrical connection by crimping, brazing, or other suitable means. In one embodiment, the end regions of the braided lead wires can be masked prior to the anodization process. Masking can be accomplished physically (e.g., by taping-over the braid lead wire end portions) or by coating the braided wire end portions with a chemical resist. Alternatively, the braided lead wires can be anodized in their entirety, and the portion of the alumina shell formed over the braided lead wire ends can subsequently be removed by, for example, treatment with a caustic solution; e.g., in one embodiment wherein the braided lead wires are anodized in their entirety, the opposing end portions of the braided lead wires may be dipped or wiped with an NaOH solution to remove the oxide coating therefrom. Testing has shown that, by forming an insulating layer of alumina over the braided lead wires through such an anodization process, the breakdown potential of embodiments of electromagnetic coil assembly 10 (FIGS. 1-4) can be improved significantly to add margin and offset any decrease in breakdown potential observed at higher temperatures.

Figure 11:
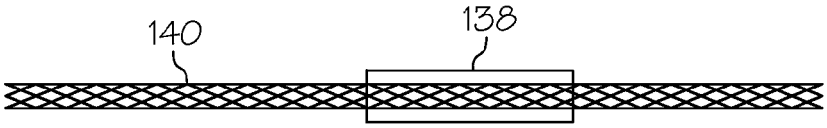
FIGS. 11-14 illustrate an exemplary brazed lead wire/pin assembly, as shown at various stages of manufacture, that may be produced pursuant to the exemplary method shown in FIG. 10.
Figure 12:
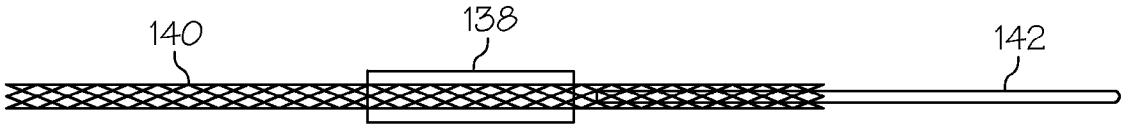

Next, at STEP 136 (FIG. 10), braze stop-off material is applied to each braided lead wire and an electrically-conductive interconnect member is placed in contact with the wire braid; e.g., in the illustrated example wherein the interconnect member is an interconnect pin and the wire braid is a hollow braided lead wire, an end portion of the interconnect pin can be inserted into the wire braid. With reference to FIG. 11, a braze-stop off material 138 may be applied to each braided lead wire 140 adjacent the location at which the braided lead wire is to be brazed to the electrically-conductive pin. Braze-stop off material 138 prevents excessive wicking of the braze material (described below) into braided lead wire 140, which could otherwise render the lead wire excessively brittle. The braze stop-off material may be a ceramic powder applied in paste form and subsequently allowed to dry. Prior to or after application of braze stop-off material 138, an electrically-conductive interconnect pin 142 may be inserted into the end portion of wire braid 140. Although not shown in FIG. 11, a fixture or a crimp piece (e.g., a relatively small aluminum crimp barrel) can be utilized to secure braided lead wire 140 in place over electrically-conductive pin 142 during the below-described brazing process.

Figure 13:
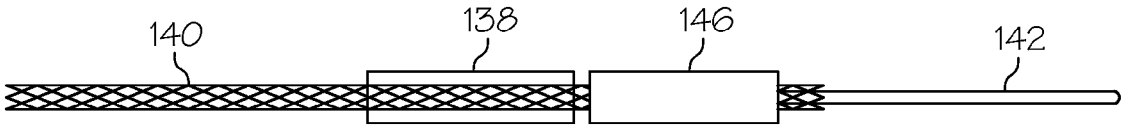
Figure 14:
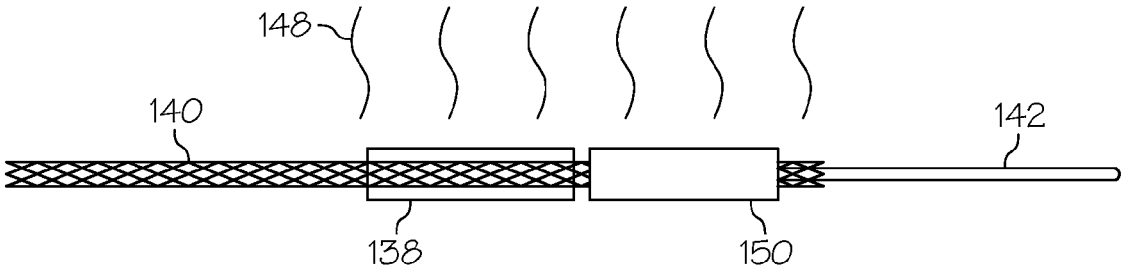

A brazing process is performed to join each braided lead wire to its respective electrically-conductive interconnect member or other conductor (STEP 144, FIG. 10). As shown in FIG. 13, a body of braze material 146 may be applied over the end portion of braided lead wire 140 into which interconnect pin 142 has been inserted. Braze material 146 is preferably applied to braided lead wire 140 as a paste, but may be applied in other forms, as well, including as a braze foil or wire. Flux may also be applied in conjunction with material paste 146 to provide surface wetting for improved adherence of the braze material. The assembly may then be heated (indicated in FIG. 14 by heat lines 148) to a predetermined braze temperature exceeding the melt point of the braze paste, but less than the melt point of aluminum to produce a braze joint 150 (FIG. 14). Brazing is performed in a controlled atmosphere furnace to precisely control the temperature to which the aluminum wire braid 140 is heated and thereby prevent the overheating thereof. Suitable furnaces include vacuum, induction, and inert atmosphere furnaces, with induction furnaces generally preferred in view of their ability to allow a more rapid increase in thermal profile during brazing. The furnace atmosphere is preferably substantially devoid of oxidants and may be either reducing atmosphere or a partial vacuum; although in embodiments wherein the heating process is sufficiently rapid to significantly reduce or eliminate the occurrence of oxidation, an inert or reducing atmosphere may not be required. During heat treatment, the furnace temperature is preferably rapidly increased from the starting temperature to the predetermined braze temperature and, after sufficient time has elapsed, rapidly decreased to a finish temperature. Such a rapid ramp up and ramp down in processing temperature minimizes the formation of oxides and intermetallics within the braze joint. After the above-described brazing process, any residual flux and/or braze-stop off may be removed to avoid corrosion during subsequent operation of the electromagnetic coil assembly due to the presence of fluorine, chlorides, or other such corrosion-causing agents. The residual flux and braze stop-off material is conveniently removed by submersion in an ultrasonic solvent bath.

At this juncture in exemplary method 130, a number of brazed lead wire/pin assemblies have been fabricated. In preferred embodiments, each brazed lead wire/pin assembly is produced by brazing a fine gauge aluminum wire braid to a non-aluminum interconnect pin; however, the risks of overheating of the fine gauge aluminum braid are eliminated by performing the brazing process prior to assembly of the electromagnetic coil assembly and in a highly controlled environment, such as a controlled atmosphere induction furnace. Each brazed lead wire/pin assembly may now be incorporated into an electromagnetic coil assembly to provide connection between the coiled magnet wire and the conductors of the feedthrough connector. For example, as indicated in FIG. 10 at STEP 154, a first braided lead wire included in a first brazed lead wire/pin assembly (e.g., braided lead wire 36 shown in FIGS. 1-7) may be joined to a first end of the magnet wire (e.g., magnet wire 26 shown in FIGS. 1 and 6) prior to winding. As noted above in conjunction with FIG. 5, joinder of the braided lead wire to the magnet wire end is preferably accomplished by crimping (note tapered crimp joint 40 in FIG. 5), but may also be accomplished utilizing other suitable wire joining techniques (e.g., brazing). The wire winding process, such as the previously-described wet winding process, is then performed to form one or more electromagnetic coils, which may extend around bobbin 12 (FIGS. 1-4 and 6) or other support member. After winding, the outer terminal end of the magnet wire (e.g., magnet wire 26 shown in FIGS. 1 and 6) may be joined (e.g., crimped and/or brazed) to a second braided lead wire included in a second brazed lead wire/pin assembly (e.g., braided lead wire 38 shown in FIGS. 1-3). The pins of the brazed lead wire/pin assemblies may then be disposed through the electrically-conductive body of a feedthrough interconnect structure (STEP 158). For example, as shown in FIGS. 8 and 9 and described in detail above, pins 104 and 106 may be inserted through mating openings provided in machinable ceramic body 102. The opposing ends of pins 104 and 106 are then interconnected with the corresponding conductors of a feedthrough connector, such as wires 84 of feedthrough connector 80 (FIGS. 8 and 9). Finally, at STEP 160 (FIG. 10), additional steps are performed to complete manufacture of the electromagnetic coil assembly; e.g., the electromagnetic coil assembly may be sealed within a housing, such as canister 71 (FIGS. 6 and 7) in the above-described manner.

The foregoing has thus provided embodiments of an electromagnetic coil assembly wherein flexible, braided lead wires are joined to a coiled magnet wire partially or wholly embedded within a body of dielectric material to provide a convenient and robust electrical connection between an external circuit and the potted electromagnetic coil, while effectively protecting the magnet wire from mechanical stress during assembly that could otherwise fatigue and work harden the magnet wire. As braided lead wires are fabricated from multiple interwoven filaments, braided lead wires also provide redundancy and thus increase the overall reliability of the electromagnetic coil assembly. The usage of flexible braided lead wires can be advantageous in certain low temperature applications wherein the coiled magnet wire is potted within a relatively rigid, organic dielectric, such as a hard plastic; however, the usage of such flexible braided lead wires is particularly advantageous in high temperature applications wherein highly rigid, inorganic materials are utilized, which are capable of maintaining their electrically-insulative properties at temperatures well-above the thresholds at which conventional, organic dielectrics breakdown and decompose. In such embodiments, the electromagnetic coil assembly is well-suited for usage in high temperature coiled-wire devices, such as those utilized in avionic applications. More specifically, and by way of non-limiting example, embodiments of the high temperature electromagnetic coil assembly are well-suited for usage within actuators (e.g., solenoids and motors) and position sensors (e.g., variable differential transformers and two position sensors) deployed onboard aircraft. This notwithstanding, it will be appreciated that embodiments of the electromagnetic coil assembly can be employed in any coiled-wire device, regardless of the particular form assumed by the coiled-wire device or the particular application in which the coiled-wire device is utilized.

The foregoing has also provided embodiments of a method for manufacturing an electromagnetic coil assembly. In one embodiment, the method includes step of pre-brazing a lead wire to a connector pin prior to crimping the opposing end of the lead wire to a magnet wire. In the process, the flow of braze can be precisely controlled by braze stop-off and the braze applied to the aluminum braid and pin in a paste form. The paste is dried then the assembly is heated in a controllable fashion in a furnace to melt the braze. In addition to precise thermal control, furnaces also provide the ability to control the atmospheric environment in which brazing takes place to minimize aluminum oxidation and promote flow. As a still further advantage, the furnace temperature can be precisely controlled to minimize exposure at peak temperature and reduce the formation of undesired intermetallics. After brazing, the flux and braze-stop materials are easily removed by immersing the lead wire/pin assembly in a vessel with solvent, which can be agitated by exposure to ultrasonic energy to promote chemical removal of the flux and braze-stop materials.

In the above-described embodiments, braided lead wires were pre-brazed to elongated pins, such as pins 104 and 106 shown in FIGS. 8 and 9, it is emphasized that the braided lead wires can be pre-brazed to other types of electrically-conductive interconnect members. For example, in further embodiments, the electrically-conductive interconnect member may assume the form of an elongated body having an opening, bore, or socket into which the braided lead wire is inserted along with braze material and flux. In this latter case, the braided lead wires can be either hollow braids or flat braids, and the socket may be lightly crimped over the braided lead wire to secure the lead wire in place during the brazing process. This notwithstanding, it is generally preferred that the electrically-conductive interconnect members assume the form of elongated, generally cylindrical pins, and the braided lead wires assume the form of hollow braids that can be slipped or threaded over the pin ends to facilitate the above-described pre-brazing process.

In further embodiments, the above-described electromagnetic coil assembly manufacturing process includes the step of producing a braided aluminum lead wire having an anodized intermediate portion, a non-anodized first end portion, and a non-anodized second end portion. The non-anodized first end portion of the braided aluminum lead wire is electrically coupled to a magnet wire, either before or after winding of the magnet wire into one or more electromagnetic coils. The non-anodized second end portion of the braided aluminum lead wire is joined to an electrically-conductive interconnect member. The term "non-anodized," as appearing herein, denotes a portion of an aluminum wire that is substantially free of an aluminum oxide shell. Thus, an end portion of a braided lead wire that is anodized and then subsequently treated to remove the oxide shell therefrom is considered "non-anodize" in the present context. For example, a braided lead wire having non-anodized end portions and an anodized intermediate portion by anodizing the body of braided lead wire after masking the end portions thereof or, alternatively, by anodizing the braided lead wire in its entirety and subsequently removing the outer alumina shell from the lead wire's end portions by exposure to NaOH or another caustic solution, as generally described above in conjunction with FIG. 10.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A method for manufacturing an electromagnetic coil assembly, comprising:

providing a braided aluminum lead wire having a first end portion and a second end portion;

brazing the first end portion of the braided aluminum lead wire to an electrically-conductive interconnect member;

winding a magnet wire into an electromagnetic coil;

joining the second end portion of the braided aluminum lead wire to the magnet wire after the step of brazing; and applying a braze stop-off material adjacent the first end portion of the braided aluminum lead wire prior to the step of brazing.

2. The method according to claim 1 wherein the step of brazing comprises brazing the first end portion of the braided aluminum lead wire to the first electrically-conductive interconnect member in a controlled atmosphere furnace.

3. The method according to claim 2 wherein the step of brazing is performed in an induction furnace within a non-oxidizing atmosphere.

4. The method according to claim 1 further comprising the step of removing the braze stop-off material after the step of brazing by submerging the braided aluminum lead wire in an ultrasonic solvent bath.

5. The method according to claim 1 further comprising the step of selecting the electrically-conductive interconnect member to have a coefficient of thermal expansion exceeding about 18 parts per million per degree Celsius.

6. The method according to claim 5 further comprising the step of fabricating the electrically-conductive interconnect member from stainless steel.

7. The method according to claim 1 wherein the electrically-conductive interconnect member comprises an electrically-conductive pin, and wherein the step of brazing comprises:

inserting a first end portion of the electrically-conductive pin into an opening provided in the braided aluminum lead wire;

applying a braze paste over the portion of the braided aluminum lead wire into which the first end portion of the electrically-conductive pin is inserted; and heating the braze paste to a predetermined braze temperature exceeding the melt point of the braze paste to braze the electrically-conductive pin to the braided aluminum lead wire.

8. The method according to claim 7 further comprising:

providing an electrically-insulative body having an opening sized to receive the electrically-conductive pin therethrough; and disposing the electrically-conductive pin through the opening provided in the electrically-insulative body.

9. The method according to claim 7 further comprising joining a second opposing end portion of the electrically-conductive pin to a conductor included within a feedthrough connector.

10. The method according to claim 1 wherein the step of winding comprises winding an aluminum magnet wire into the electromagnetic coil, and wherein the step of joining comprises crimping the second end portion of the braided aluminum lead wire to the aluminum magnet wire after the step of brazing.

11. The method according to claim 1 further comprising the step of anodizing the braided lead wire such that an aluminum oxide shell encases an intermediate portion of the braided aluminum lead wire, while leaving the first end portion and the second end portion of the braided lead wire exposed.

12. A method for manufacturing an electromagnetic coil assembly, comprising:

producing a braided aluminum lead wire having an anodized intermediate portion, a non-anodized first end portion, and a non-anodized second end portion;

electrically coupling the non-anodized first end portion of the braided aluminum lead wire to a magnet wire; and joining the non-anodized second end portion of the braided aluminum lead wire to an electrically-conductive interconnect member;

wherein producing comprises:

interweaving a plurality of non-anodized aluminum filaments into an elongated master braid;

cutting the elongated master braid into braid bundles of desired lengths; and anodizing the braid bundles to produce the braided aluminum lead wire along with a plurality of other braided aluminum lead wires.

13. The method according to claim 12 wherein the entire braid bundles are anodized to form aluminum oxide shells thereover, and wherein the producing further comprises:

exposing opposing end portions of the braid bundles to a caustic solution to remove the aluminum oxide shell therefrom.

14. The method according to claim 12 wherein the step of producing further comprises:

masking opposing end portions of the braid bundles; and anodizing the braided bundles after masking to form aluminum oxide shells over intermediate portions the braid bundles.

15. The method according to claim 12 wherein the step of electrically coupling comprises crimping the non-anodized first end portion of the braided aluminum lead wire to the magnet wire.

16. A method for manufacturing an electromagnetic coil assembly, comprising:

providing a braided lead wire having a first end portion and a second end portion;

joining the second end portion of the braided lead wire to a coiled magnet wire;

prior to joining the second end portion of the braided lead wire to the coiled magnet wire, brazing the first end portion of the braided lead wire to a connector member; and forming an inorganic dielectric body around the coiled magnet wire after joining the second end portion of the braided lead wire thereto;

wherein the second end portion of the braided lead wire is joined to the coiled magnet wire at a joint buried in inorganic dielectric body; and wherein the braided lead wire extends from the connector member, into the inorganic dielectric body, and to the coiled magnet wire to provide an electrical connection between the connector member and the coiled magnet wire embedded in the inorganic dielectric body.

17. The method of claim 16 wherein the braided lead wire comprises a plurality of interwoven aluminum filaments.

18. The method of claim 16 wherein joining comprises crimping the second end portion of the aluminum lead wire to the coiled magnet wire.

19. The method of claim 16 wherein the inorganic dielectric body comprises one of the group consisting of an inorganic cement and a low melt glass.

20. The method of claim 16 wherein forming comprises forming the inorganic dielectric body utilizing a wet winding process.

* * * * *